US007445110B2

(12) United States Patent
Hartley

(10) Patent No.: US 7,445,110 B2
(45) **Date of Patent: *Nov. 4, 2008**

(54) BAILING APPARATUS WITH HANDLE RETURN DEVICE

(75) Inventor: Gary L. Hartley, North Fair Field, OH (US)

(73) Assignee: Berry Plastics Corporation, Evansville, IN (US)

( * ) Notice: Subject to any disclaimer, the term of this patent is extended or adjusted under 35 U.S.C. 154(b) by 583 days.

This patent is subject to a terminal disclaimer.

(21) Appl. No.: 10/994,072

(22) Filed: Nov. 19, 2004

(65) Prior Publication Data

US 2006/0110240 A1 May 25, 2006

(51) Int. Cl.
*B65G 29/00* (2006.01)

(52) U.S. Cl. ..... 198/392; 198/396; 221/159

(58) Field of Classification Search ..... 221/159; 198/382, 392, 393, 396
See application file for complete search history.

(56) References Cited

U.S. PATENT DOCUMENTS 2,946,361 A * 7/1960 Skog et al. ..... 99/550
4,352,440 A * 10/1982 Fukai et al. ..... 221/178
4,601,160 A * 7/1986 Heisler ..... 53/485
5,065,852 A * 11/1991 Marti ..... 198/392
5,191,960 A * 3/1993 Wareham ..... 198/391
5,547,335 A * 8/1996 Lovett et al. ..... 414/795.6
5,713,454 A * 2/1998 Jordan ..... 198/391
5,746,570 A * 5/1998 Gujda et al. ..... 414/795.6
5,954,184 A * 9/1999 Schmitt ..... 198/392
6,523,328 B1 * 2/2003 De Cardenas et al. ..... 53/399
7,097,444 B2 * 8/2006 Hartley ..... 425/436 R
7,219,789 B2 * 5/2007 Hartley ..... 198/397.04

OTHER PUBLICATIONS

Photo-images of infeed device and bailer that receives handles from infeed device (12 sheets) (Oct. 20, 2003).

* cited by examiner

*Primary Examiner*—Douglas A Hess
(74) *Attorney, Agent, or Firm*—Barnes & Thornburg LLP

(57) ABSTRACT

A bailing apparatus includes a bailer feeder and a handle return device. The bailer feeder is adapted to feed handles to a bailer which couples the handles to containers. The handle return device is arranged to return handles that fall from the bailer feeder back to the bailer feeder.

32 Claims, 17 Drawing Sheets

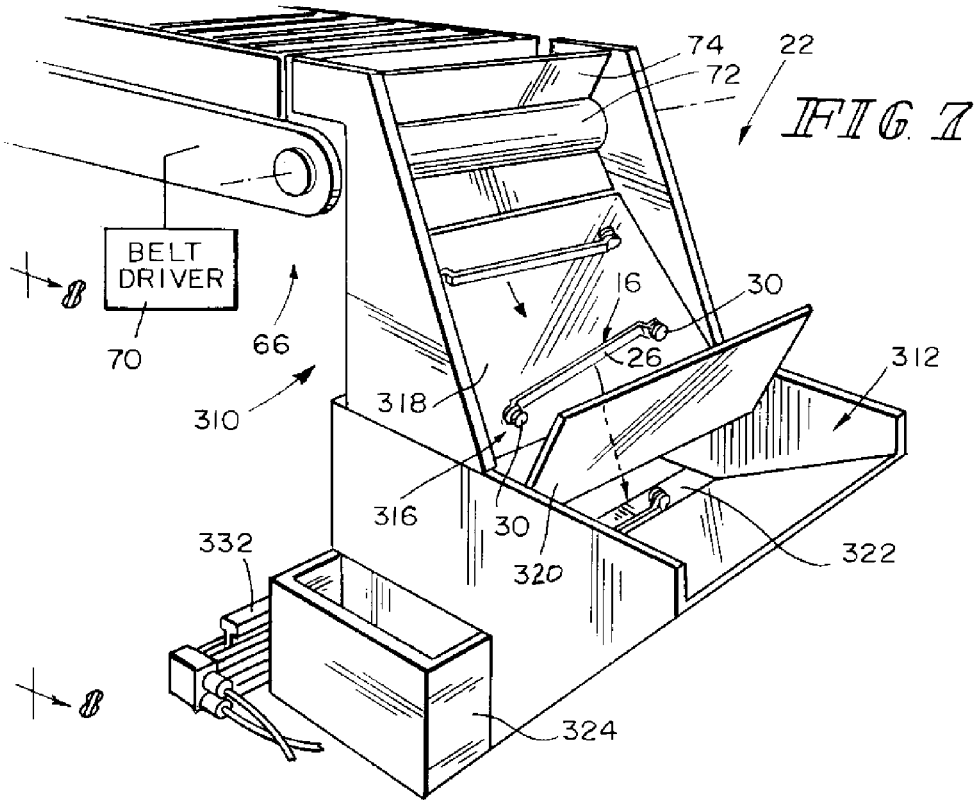
FIG. 7
FIG. 8
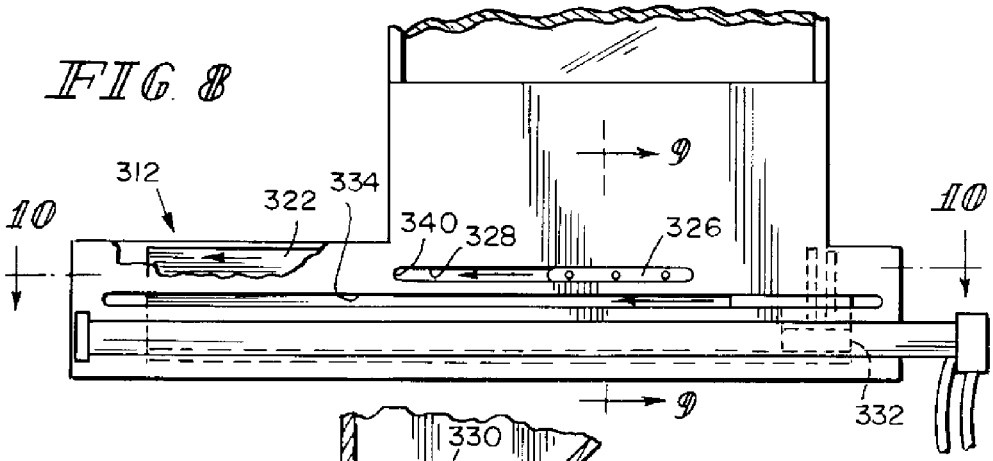
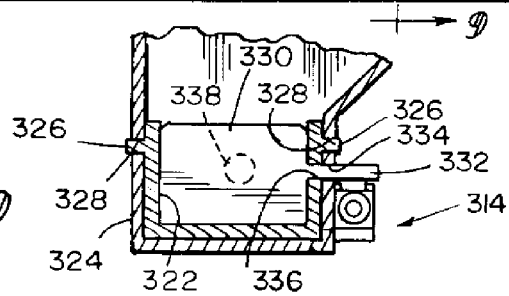
FIG. 9

16
26
166
30
162
155
156
30

16
28
169
171
26
182
175
178
164
34
182
170
186
176
194
166
155
158
26
16
160
184
23
23
190
157
162
190
26

192
168
192
26
16
206
198
196
206
188
16
210
24
210
200
204
202

BAILING APPARATUS WITH HANDLE RETURN DEVICE

BACKGROUND

The present disclosure relates to bailing apparatus for coupling handles to containers.

SUMMARY

According to the present disclosure, a bailing apparatus includes a bailer, a bailer feeder, and a handle return device. The bailer is adapted to couple handles to containers. The bailer feeder is arranged to feed handles to the bailer. The handle return device is arranged to return handles that have fallen from the bailer feeder from a location to which the handles have fallen back to the bailer feeder.

Illustratively, the handle return device includes a catcher and an elevator. The catcher is arranged to catch handles that fall from the bailer feeder and to deliver the caught handles to the elevator. The elevator is arranged to elevated the handles received from the catcher and to return such handles back to the bailer feeder.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which:

FIG. 7 is a perspective view of the handle supplier, with portions broken away, showing supply of handles from a conveyor belt device to a collector;

FIG. 8 is a sectional view of the handle supplier taken along lines 8-8 of FIG. 7;

FIG. 9 is a sectional view of the handle supplier taken along lines 9-9 of FIG. 8 showing a collection box of the collector nested in a box support of the collector to receive handles from the conveyor belt device and the handle return device;

DETAILED DESCRIPTION

Figure 1:
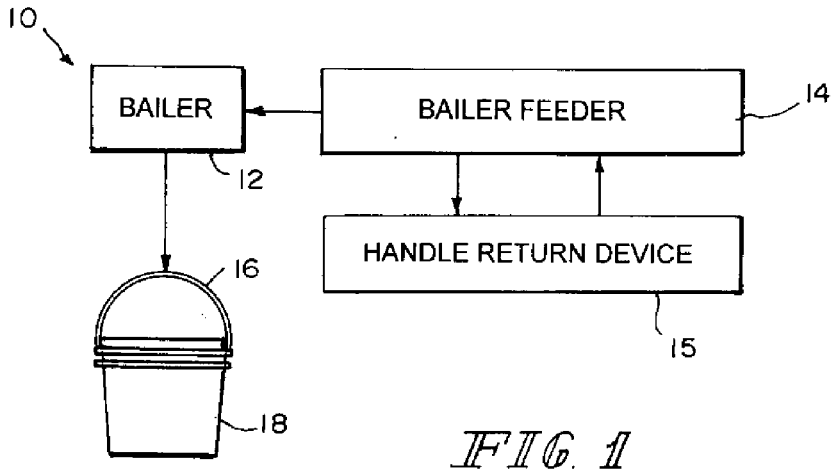
FIG. 1 is a diagrammatic view showing a bailing apparatus that includes a bailer feeder for feeding handles to a bailer which is adapted to couple the handles to containers and showing a handle return device that is included in the bailer feeder and arranged to return handles that have fallen from the bailer feeder from a location to which the handles have fallen back to the bailer feeder.

A bailing apparatus 10 includes a bailer 12, a bailer feeder 14, and a handle return device 15, as shown diagrammatically, for example, in FIG. 1. Bailer 12 is adapted to couple handles 16 to containers 18. Bailer feeder 14 is arranged to feed handles 16 to bailer 12. Handle return device 15 is arranged to return handles 16 that have fallen from bailer feeder 14 from a location to which handles 16 have fallen back to bailer feeder 14. Return device 15 thus provides handle return means for returning handles 16 that have fallen from bailer feeder 14 from a location to which handles 16 have fallen back to bailer feeder 14.

Figure 2:
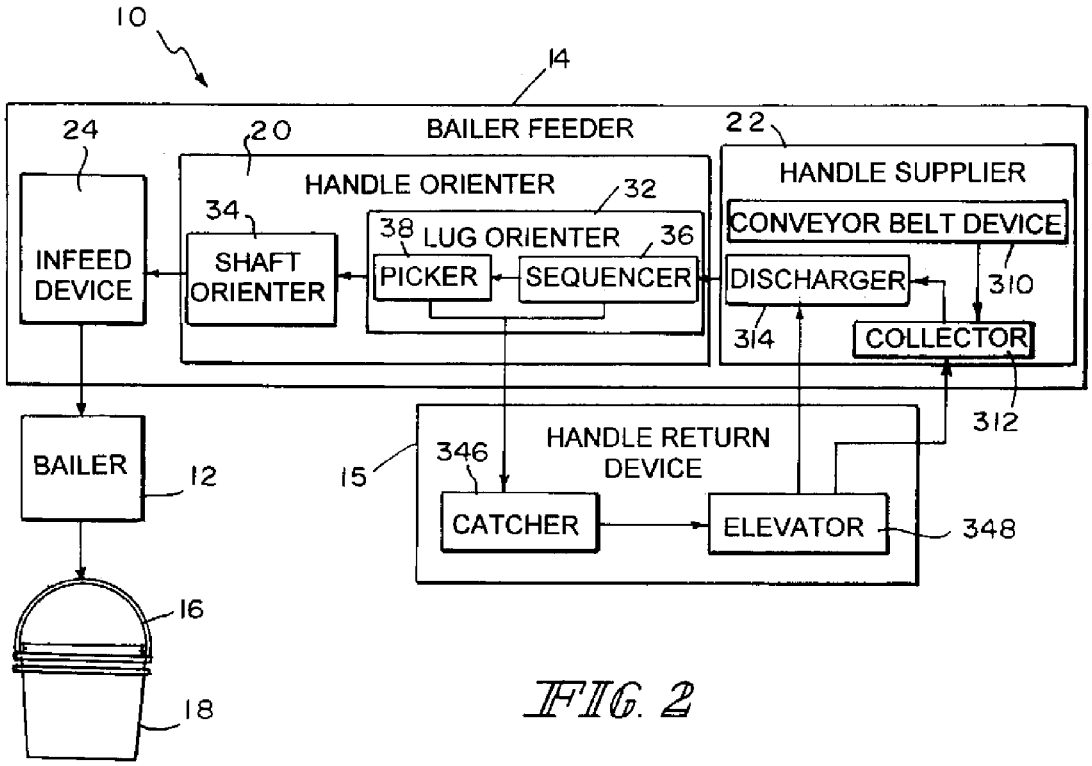
FIG. 2 is a diagrammatic view showing a catcher that is included in the handle return device and arranged to catch handles that fall from components included in a handle orienter of the bailer feeder and an elevator that is included in the handle return device and arranged to return handles caught by the catcher to a handle supplier of the bailer feeder.

Bailer feeder 14 includes a handle supplier 22, a handle orienter 20, and an infeed device 24, as shown diagrammatically, for example, in FIG. 2. Supplier 22 is adapted to supply handles 16 without a predetermined orientation to orienter 20. Orienter 20 is arranged to orient handles 16 received from supplier 22 so that handles 16 have the predetermined orientation and is arranged to deliver the oriented handles 16 to infeed device 24. Infeed device 24 is arranged to feed handles 16 that have the predetermined orientation to bailer 12.

Handle supplier 22 includes a conveyor belt device 310, a collector 312, and a discharger 314, as shown diagrammatically, for example, in FIG. 2 and shown, for example, in FIGS. 7-12. Each of conveyor belt device 310 and handle return device 15 is arranged to provide handles 16 to collector 312. Discharger 314 is arranged to discharge handles 16 collected by collector 312 from collector 312 to orienter 20.

Each of conveyor belt device 310 and handle return device 15 is under the control of a controller 112 so that belt device 310 and return device 15 provide handles 16 to collector 312 according to a predetermined sequence. For example, controller 112 is configured to cause belt device 310 to provide handles 16 to collector 312 three out of every four times that handles 16 are provided to collector 312 by one of devices 310, 15 and configured to cause return device 15 to provide handles 16 to collector 312 one out of every four times that handles 16 are provided to collector 312 by one of devices 310, 15.

Conveyor belt device 310 includes a conveyor 66 and a guide 316, as shown, for example, in FIG. 7. Conveyor 66 includes a belt driver 70 that drives a belt 72 to move handles 16 without the predetermined orientation toward guide 316. Dividers 74 on belt 72 facilitate movement of handles 16 by belt 72. At an end of conveyor 66, belt 72 drops handles 16 to guide 316 which guides the falling handles 16 to collector 312. A pair of spaced-apart sloping guide walls 318, 320 of guide 316 cooperate to guide handles 16 to collector 312.

Collector 312 includes a collection box 322 and a box support 324, as shown, for example, in FIGS. 8-12. Box 322 is arranged for receiving handles 16 from each of conveyor belt device 310 and handle return device 15. Box support 324 supports box 322 for movement of box 322 relative to box support 324 toward and away from a bin 42 of orienter 20 in response to operation of discharger 314.

Box 322 includes a pair of followers 326, as shown, for example, in FIGS. 8-12. Each follower 326 extends into a shorter support slot 328 formed in box support 324 for movement back and forth in short support slot 328 upon movement of box 322 relative to box support 324.

Discharger 314 includes a pusher 330 and a pusher shuttler 332, as shown, for example, in FIGS. 9-12. Pusher 330 is configured, for example, as a wall located in box 322. Pusher shuttler 322 (e.g., an air cylinder) extends through a longer support slot 334 that is formed in box support 324 and longer than each shorter support slot 328 and extends through a box slot 336 formed in collection box 322 to pusher 330. Pusher shuttler 322 is coupled to pusher 330 and arranged to move pusher 330 toward bin 42 to discharge handles 16 into a compartment 56 of bin 42 and away from bin 42 to receive more handles 16 in box 322.

Figure 10:
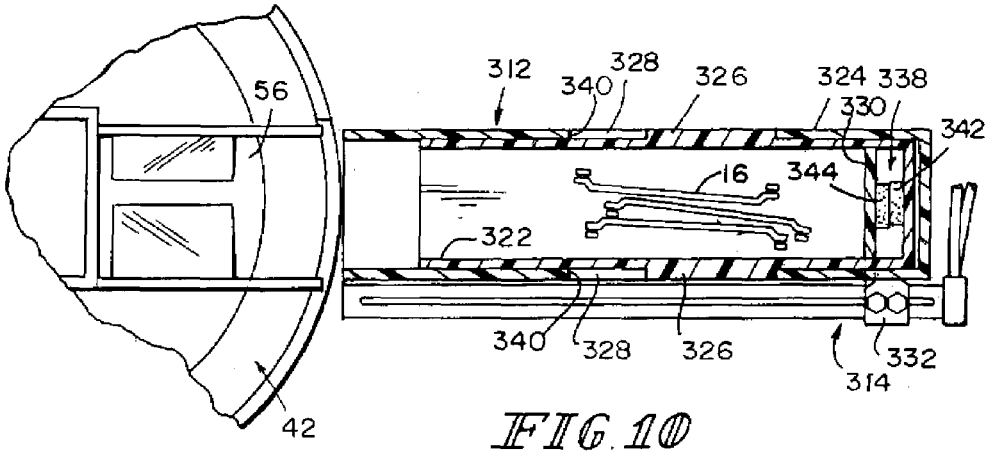
FIG. 10 is a sectional view taken along lines 10-10 of FIG. 8 showing the collection box positioned in a collection position to collect handles received from the conveyor belt device and the handle return device.
Figure 11:
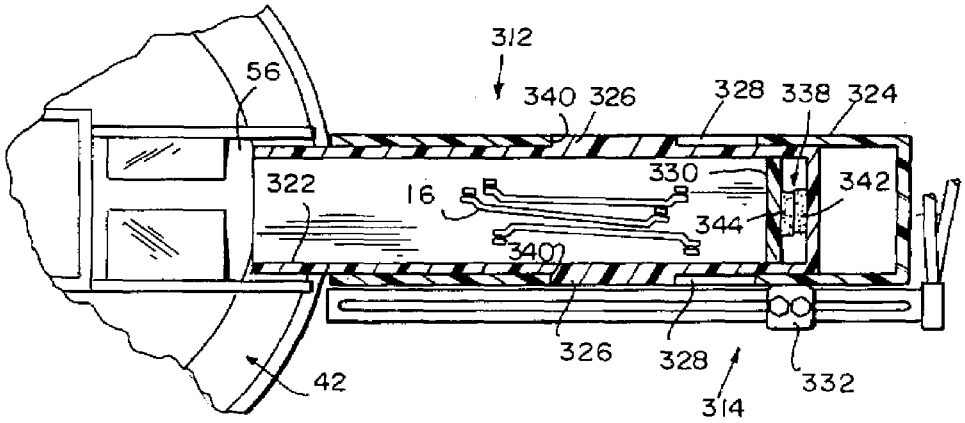
FIG. 11 is a sectional view similar to FIG. 10 showing movement of the collection box into engagement with a stop included in the box support so that the collection box assumes a discharge position in which the collection box extends into a compartment included in the bin to facilitate discharge of handles from the collection box into the compartment.
Figure 12:
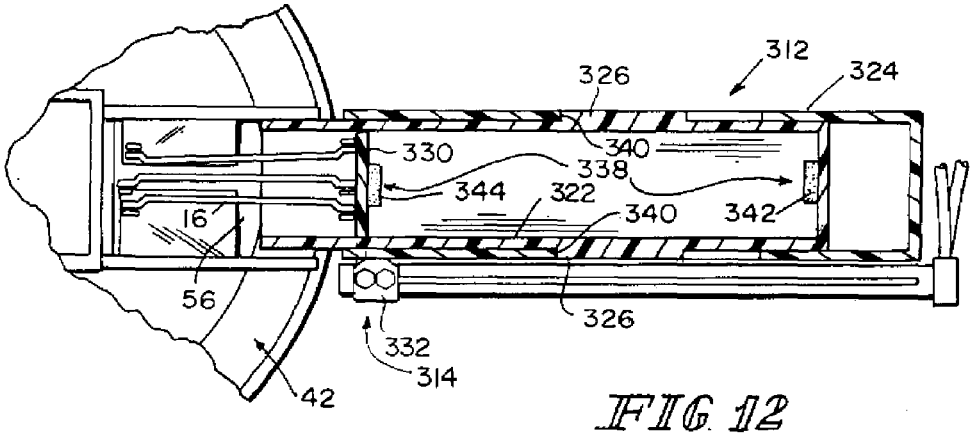
FIG. 12 is a sectional view similar to FIGS. 10 and 11 showing movement of a pusher located in the collection box by a pusher shuttler to push handles out of the collection box into the compartment.

A releasable connector 338 is coupled to collection box 322 and pusher 330, as shown, for example, in FIGS. 10-12. Connector 338 is arranged to connect box 322 and pusher 330 to move box 322 relative to box support 324 between a collection position shown, for example, in FIG. 10 and a discharge position shown, for example, in FIGS. 11 and 12 in response to movement of pusher 330 toward and away from bin 42 by pusher shuttler 332. In the collection position, box 322 is arranged to receive handles 16 from belt device 310 and return device 15. In the discharge position, box 322 extends into a compartment 56 of bin 42 to facilitate discharge of handles 16 from box 322 into compartment 56. Box 322 assumes the discharge position in response to engagement between each follower 326 and a stop 340 located at an end of the shorter support slot 328 in which the follower 326 extends during movement of pusher 330 toward bin 42.

Connector 338 is arranged to disconnect box 322 and pusher 330 in response to engagement between followers 326 and stops 340, as shown, for example, in FIG. 12. Such disconnection between box 322 and pusher 330 allows pusher 330 to continue to move toward bin 42 relative to box 322 and box support 324. As pusher 330 moves toward bin 42, it pushes handles 16 out of box 322 into a compartment 56 of bin 42.

After handles 16 are pushed into compartment 56, pusher shuttler 332 moves pusher 330 away from bin 42 relative to box 322 to cause connector 338 to reconnect pusher 330 and box 328. As pusher shuttler 332 continues to move pusher 330 away from bin 42 after re-connection, pusher 330 causes box 322 to withdraw from compartment 56 and move relative to box support 324 from the discharge position to the collection position.

Illustratively, connector includes a first magnet 342 and a second magnet 344, as shown, for example, in FIGS. 10-12. First magnet 342 is coupled to collection box 322 for movement therewith. Second magnet 344 is coupled to pusher 330 for movement therewith. Magnets 342, 344 are coupled to one another when box 322 is positioned in the collection position and when box 322 is traveling between the collection position and the discharge position. Magnets 342, 344 separate from one another in response to engagement between followers 326 and stops 340 during movement of pusher 330 toward bin 42.

Handle orienter 20 includes a lug orienter 32 and a shaft orienter 34, as shown diagrammatically, for example, in FIG. 2. Lug orienter 32 is arranged to orient a pair of container attachment lugs 30 that are included in each handle 16 for attachment to a container 18 and coupled to opposite ends of a shaft 26 included in handle 16 so that lugs 30 extend downwardly from shaft 26 upon delivery of handle 16 to shaft orienter 34 by lug orienter 32. Shaft orienter 34 is arranged to orient shaft 26 of each handle 16 so that shaft 26 is perpendicular to shaft orientation axis 28 along which shaft orienter 34 moves each handle 16 toward infeed device 24.

Lug orienter 32 includes a sequencer 36 and a picker 38, as shown, for example, in FIGS. 3-6. Sequencer 36 is arranged to move groups of handles 16 received from handle supplier 22 in sequence into communication with picker 38. Picker 38 is arranged to pick up handles 16 from whichever group is in communication with picker 38 and to lay down the picked-up handles 16 onto a moving belt 40 included in shaft orienter 34 so that lugs 30 of handles 16 placed on belt 40 extend downwardly from shafts 26.

Figure 13:
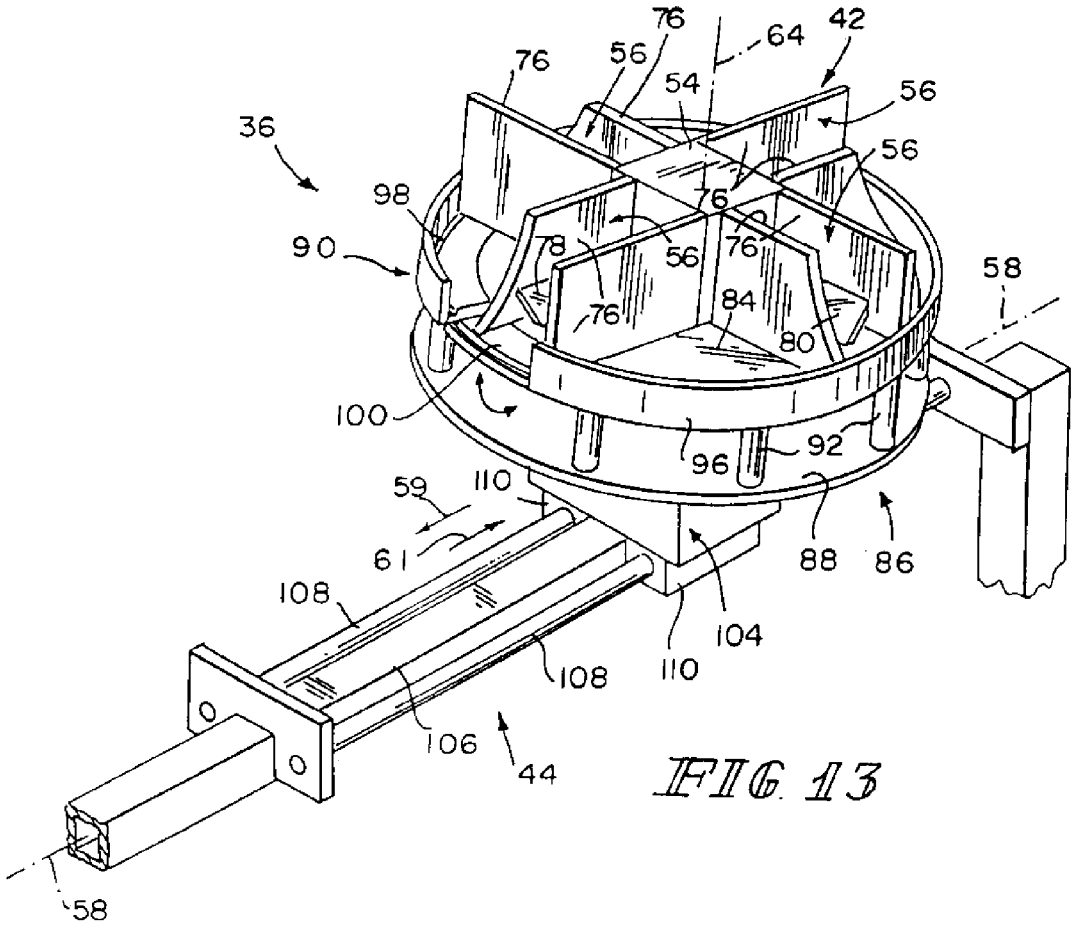
FIG. 13 is a perspective view showing the bin coupled to a bin shuttler which is arranged to move the bin back and forth along a shuttle axis between the transfer and retracted positions.

Sequencer 36 includes a bin 42 and a bin shuttler 44, as shown, for example, in FIG. 13 and picker 38 includes a rotatable wheel 46, a plurality of handle couplers 48 coupled to wheel 46, and a wheel rotator 50 (e.g., electric motor) arranged to rotate wheel 46 and handle couplers 48 coupled thereto about a wheel rotation axis 52 in a wheel rotation direction 53, as shown, for example, in FIGS. 3-6. Bin 42 includes a rotatable partition 54 formed to include a plurality of compartments 56 adapted to receive handles 16 from handle supplier 22. Bin shuttler 44 is arranged to move bin 42 along a shuttle axis 58 toward wheel 46 in a forward direction 59 (indicated in FIG. 13) to a transfer position shown, for example, in FIGS. 3 and 4 and away from wheel 46 in a rearward direction 61 (indicated in FIG. 13) to a retracted position shown, for example, in FIGS. 5 and 6.

Figure 3:
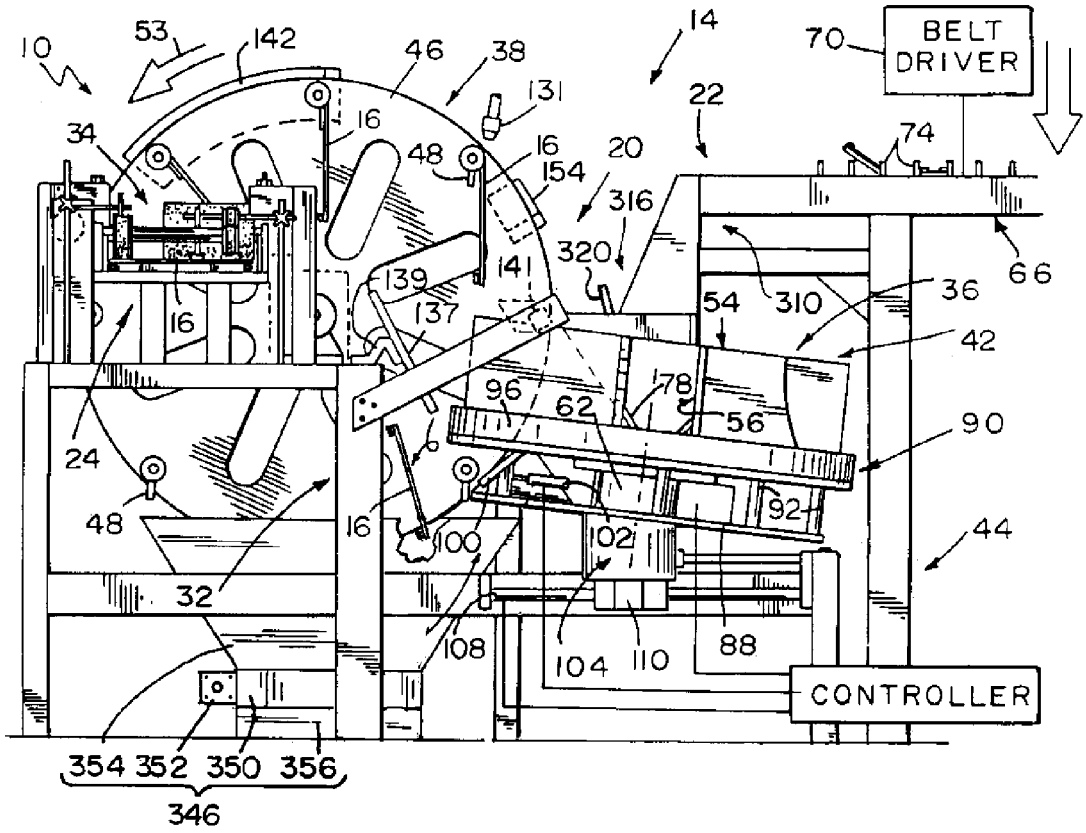
FIG. 3 is a side elevational view of the bailing apparatus showing the handle supplier supplying handles to a movable bin positioned in a transfer position adjacent a rotating wheel allowing a plurality of handle couplers coupled to the rotating wheel to pick up handles from the bin and lay down the picked-up handles onto a moving belt shown in FIG. 4 and showing the catcher positioned to catch falling handles.
Figure 4:
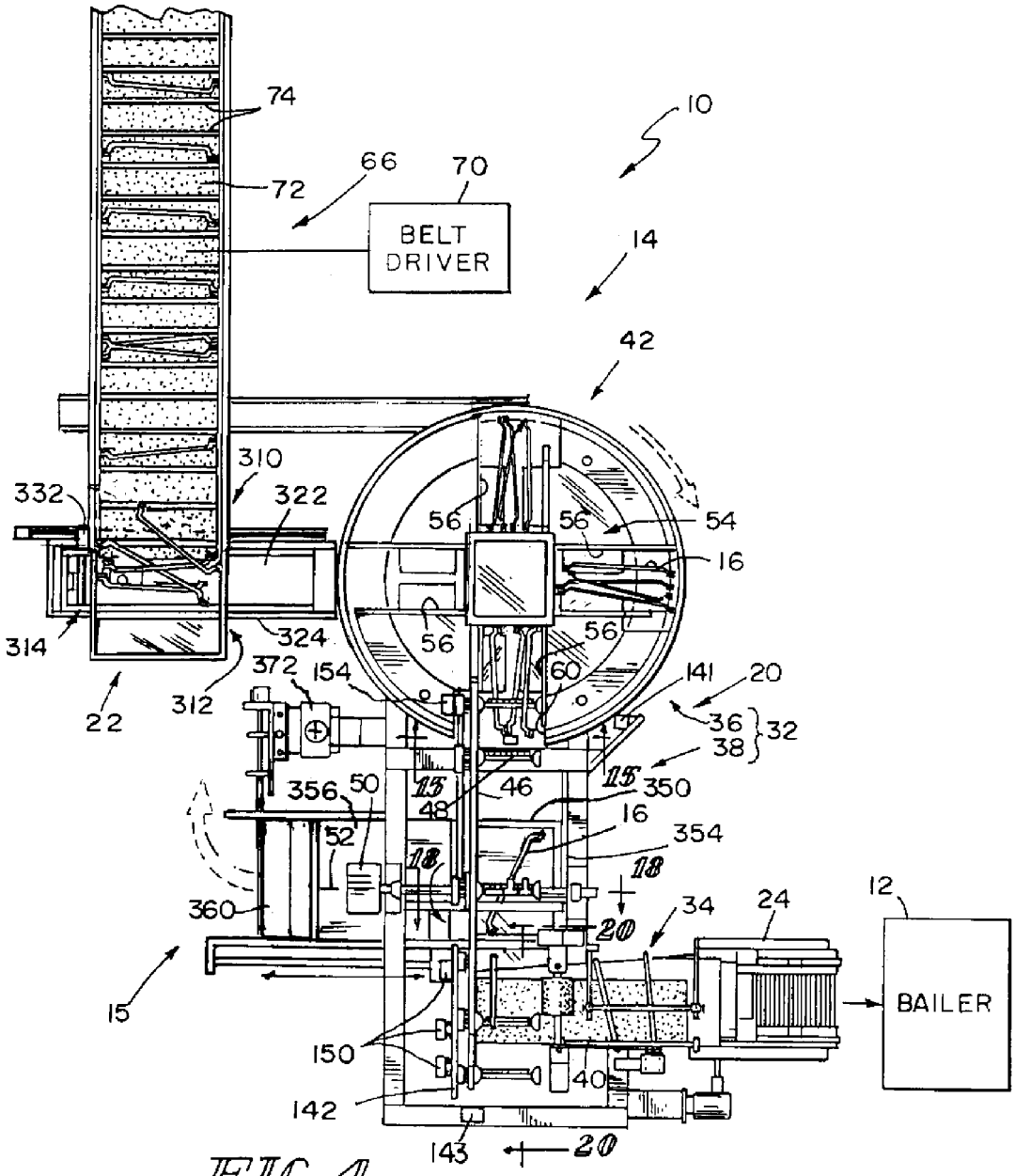
FIG. 4 is a top plan view of the bailing apparatus showing a sleeve of the catcher positioned in a catch position to catch falling handles when the bin is in the transfer position.

In the transfer position, bin 42 is positioned adjacent wheel 46, as shown, for example, in FIGS. 3 and 4. An access opening 60 formed in bin 42 receives wheel 46 therein allowing handle couplers 48 coupled to wheel 46 for rotation therewith about axis 52 to pass upwardly through access opening 60 to pick up handles 16 from a compartment 56 in communication with handle couplers 48 and lay down the picked-up handles onto belt 40.

Figure 5:
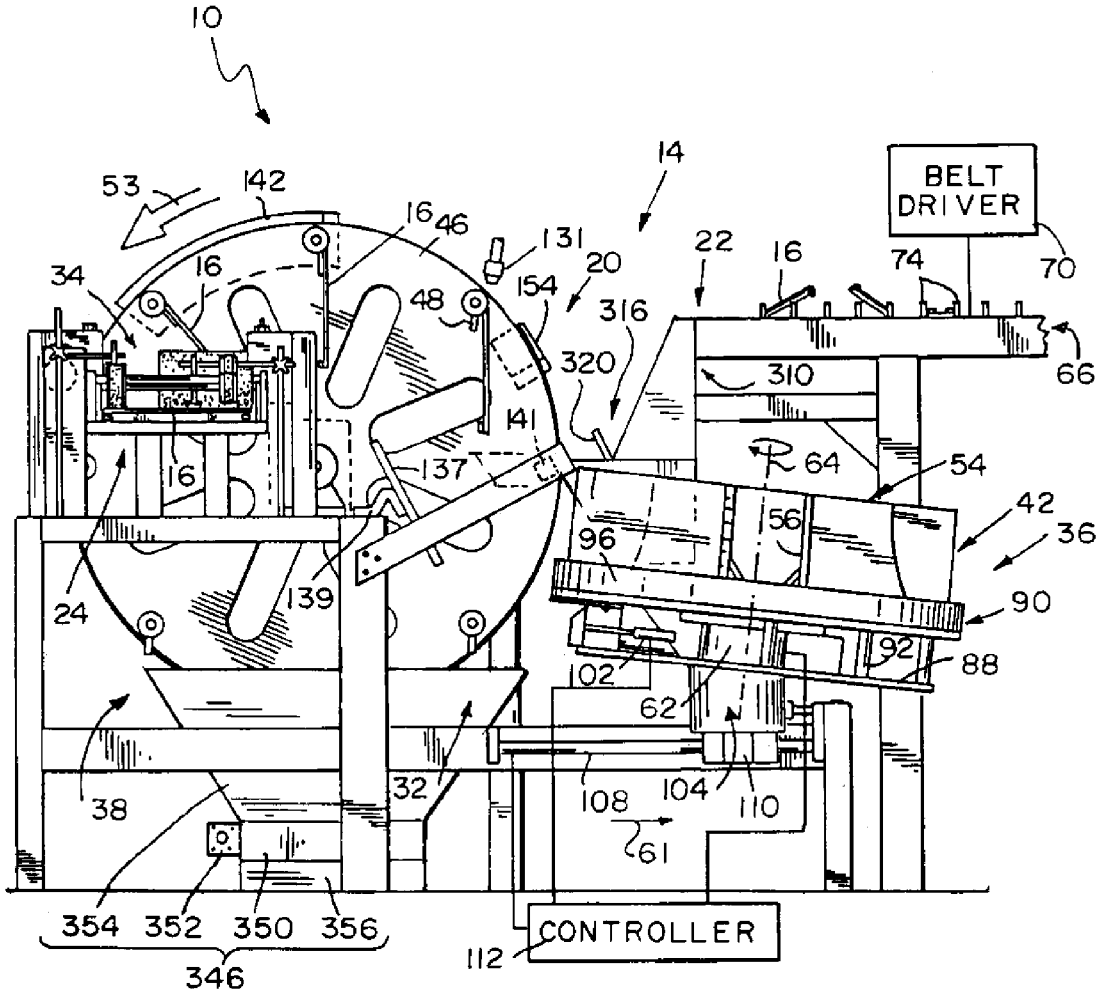
FIG. 5 is a side elevational view of the bailing apparatus showing the bin in a retracted position away from the rotating wheel allowing rotation of compartments included in the bin about a compartment rotation axis so that more handles can be provided to the handle couplers upon return of the bin to the transfer position.
Figure 6:
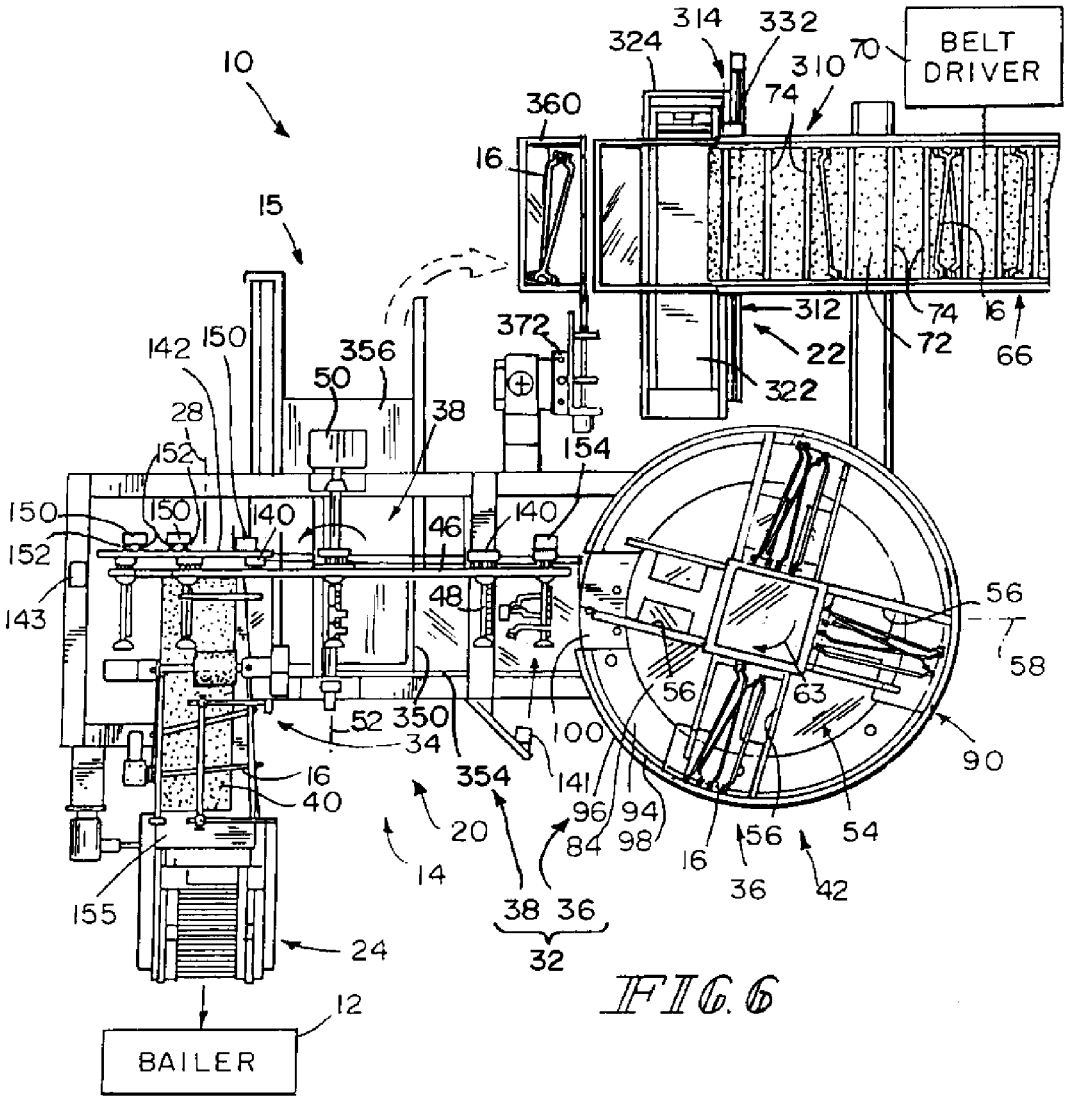
FIG. 6 is a top plan view of the bailing apparatus showing rotation of the compartments about the compartment rotation axis when the bin is positioned in the retracted position and showing a tray of the elevator positioned to provide to the handle supplier handles received from the sleeve of the catcher.

In the retracted position, bin 42 is positioned away from wheel 46, as shown, for example, in FIGS. 5 and 6. Wheel 46 is thereby positioned outside access opening 60 allowing a compartment rotator 62 (e.g., electric motor) coupled to partition 54 to rotate partition 54 and compartments 56 formed therein about a compartment rotation axis 64 in a compartment rotation direction 63 to position another compartment 56 containing more handles 16 in communication with handle couplers 48 upon return of bin 42 to the transfer position by bin shuttler 44.

Compartments 56 are spaced about compartment rotation axis 64, as shown, for example, in FIGS. 4 and 6. Illustratively, there are four compartments 56 spaced at 90° intervals about axis 64.

Figure 15:
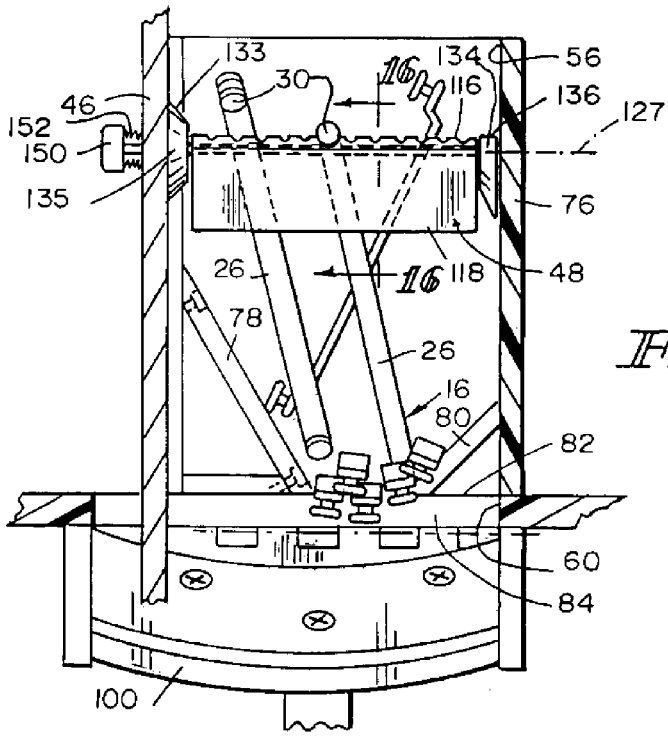
FIG. 15 is a sectional view taken along lines 15-15 of FIG. 4 showing one of the handle couplers picking up handles from a compartment included in the bin.

Each compartment 56 includes a pair of spaced-apart side walls 76 and a pair of spaced-apart guide walls 78, 80, as shown, for example, in FIG. 15. A floor 82 of each compartment 56 is provided by a disk 84 of partition 54. Guide walls 78, 80 are arranged to guide handles 16 discharged into compartment 56 from collection box 322 into a space defined between guide walls 78, 80. Guide walls 78, 80 are inclined at angles different from one another to cause handles 16 discharged into compartment 56 to tend to tumble so that lugs 30 extend generally downwardly from shafts 26 when handles 16 come to rest in compartment 56 to facilitate coupling of handles 16 to handle couplers 48.

Bin 42 includes a frame 86 that supports partition 54 and compartment rotator 62, as shown, for example, in FIGS. 3, 5, and 13. Frame 86 includes a lower plate 88, an upper retainer 90, and a plurality of struts 92 connecting plate 88 and retainer 90 to support retainer 90 above plate 88.

Retainer 90 partially surrounds partition 54 and compartments 56 formed therein to retain handles 16 in compartments 56 upon rotation of compartments 56 about compartment rotation axis 64, as shown, for example, in FIGS. 4 and 6. Retainer 90 is formed to include access opening 60. Retainer 90 includes a bottom wall 94 and a perimeter wall 96 coupled to and extending upwardly from the perimeter of bottom wall 94. Walls 94, 96 cooperate to provide access opening 60 and cooperate to provide a perimeter groove 98 adapted to receive one of lugs 30 of handles 16 in compartments 56 so that lugs 30 will be extending generally downwardly when they are placed in communication with handle couplers 48 to facilitate coupling of handles 16 to handle couplers 48.

Bin 42 includes a closure 100 and a closure mover 102, as shown, for example, in FIGS. 3-6 and 13. Closure mover 102 (e.g., air cylinder) is coupled to closure 100 and arranged to move closure between an opened position opening access opening 60 when bin 42 is positioned in the transfer position, as shown, for example, in FIGS. 3 and 4, and a closed position closing access opening 60 when bin 42 is positioned in the retracted position, as shown, for example, in FIGS. 5 and 6.

Bin shuttler 44 includes an inclined bin support 104, as shown, for example, in FIGS. 3, 5, and 13. Support 104 underlies lower plate 88 and is coupled thereto to support bin 42 in an inclined position to facilitate transfer of handles 16 to handle couplers 48. Illustratively, support 104 inclines bin 42 at an angle of about 7° with respect to a horizontal reference plane.

Bin shuttler 44 includes a driver 106 and a pair of parallel rails 108, as shown, for example, in FIGS. 3, 5, and 13. Support 104 includes a pair of feet 110. Each foot 110 receives one of rails 108 to slide thereon. Driver 106 is coupled to support 104 to cause feet 110 to slide on rails 108 and thus cause movement of bin 42 between the transfer and retracted positions. Driver 106 is configured, for example, as an air cylinder (e.g., model number SLM-40-550-KF-A-S-G-CV available from Festo Corp. of Hauppauge, N.Y.).

Bailer feeder 14 includes an electronic controller 112, as shown, for example, in FIGS. 3 and 5. Controller 112 is coupled to driver 106, compartment rotator 62, and closure mover 102 to coordinate movement of bin 42 between the transfer and retracted positions, rotation of compartments 56 about compartment rotation axis 62, and movement of closure 100 between the opened and closed positions.

Each handle coupler 48 is configured, for example, as a plate coupled to an axle 114 fixed to wheel 46, as shown, for example, in FIGS. 7-9. Coupler 48 includes a top portion 116, a bottom portion 118, and a side portion 120 extending between top and bottom portions 116, 118. Top, bottom, and side portions 116, 118, 120 extend between opposite end portions 122 of coupler 48.

Figure 14:
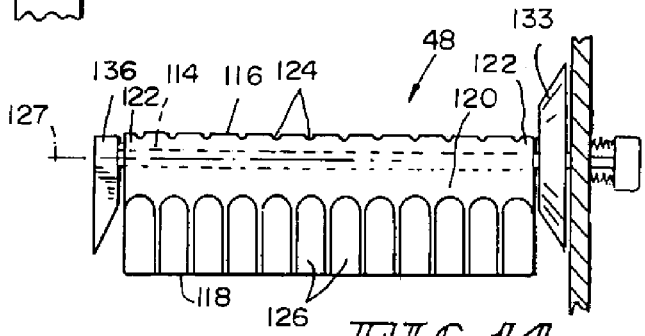
FIG. 14 is a front elevational view of one of the handle couplers.
Figure 16:
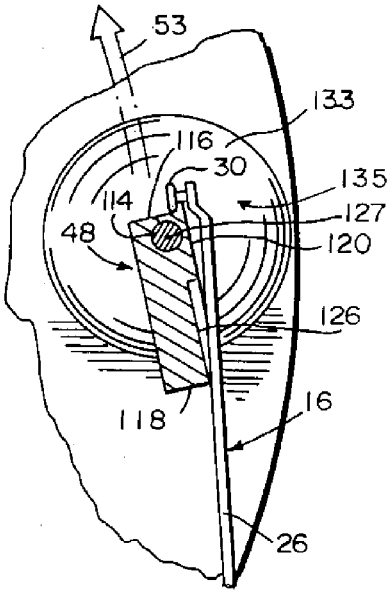
FIG. 16 is a sectional view taken along lines 16-16 of FIG. 15 showing one of the handle couplers carrying a handle during rotation of the wheel.

A plurality of lug receivers 122 for receiving lugs 30 are formed in and aligned along top portion 116 between end portions 124 of coupler 48, as shown, for example, in FIGS. 14-16. Illustratively, each lug receiver 122 is a notch formed in top portion 116 of handle coupler 48.

A plurality of shaft receivers 126 for receiving shafts 26 are formed in and aligned along side portion 120 between end portions 124, as shown, for example, in FIGS. 14 and 16. Illustratively, each shaft receiver 126 is a groove formed in side portion 120. It is within the scope of this disclosure for the depths of adjacent receivers 126 to be different from one another (e.g., to alternate between first and second depths). It is further within the scope of this disclosure for shaft receivers 126 to be formed as grooves that extend all the way through handle coupler 48.

Figure 17:
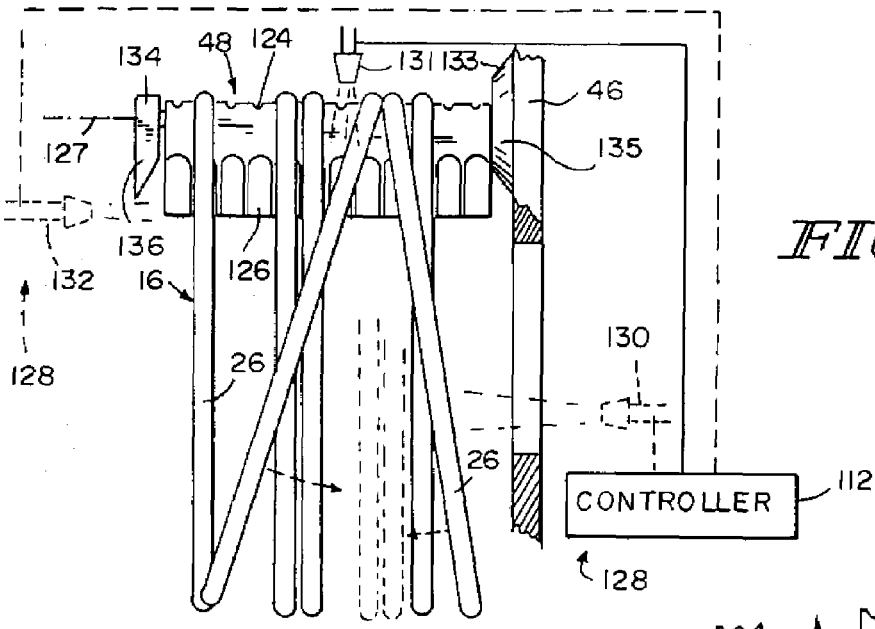
FIG. 17 is a front elevational view showing a handle disconnector configured, for example, as an air pulser arranged to direct a downward pulse of air at handles carried by each handle coupler to disconnect any handles that may have inadvertently become crisscrossed or otherwise connected.

Lug receivers 122 and shaft receivers 126 are arranged in pairs so that the lug receiver 122 and shaft receiver 126 of each pair cooperate to position a handle 16 received by the pair in generally perpendicular relation to a coupler axis 127 of coupler 48 to pre-position handle 16 to be laid down onto belt 40, as suggested, for example, in FIGS. 14 and 17. The receiver pairs thus act to position the handles 16 coupled to coupler 48 in generally parallel relation. Inclined guide surface 133 formed in plates 135 located adjacent one of end portions 122 is arranged to guide handles 16 toward the lug receiver/shaft receiver pairs.

During an attempted transfer of handles 16 from a compartment 56 to a handle coupler 48, handle coupler 48 moves against handles 16 in compartment 56 to promote coupling of lugs 30 to lug receivers 122. A guide plate 137 shown, for example, in FIG. 3 is arranged to help guide handles 16 which do not successfully couple to handle coupler 48 back into compartment 56. An air pulser 139 shown, for example, in FIG. 3 coupled to guide plate 137 and under the control of controller 112 is arranged to direct a pulse of air at handles 16 falling back into compartment 56 to promote tumbling of such handles 16 in compartment 56 so that such handles 16 will come to rest in compartment 56 with their lugs 30 extending generally downwardly. A coupler sensor 141 (e.g., a photosensor) is arranged to sense each handle coupler 48 that passes sensor 141 and is coupled to controller 112 to inform controller 112 when a handle coupler 48 passes sensor 141. Controller 112 uses this information from sensor 141 to cause air pulser 139 to generate a pulse of air each time that sensor 141 senses a handle coupler 48.

Handles 16 which are coupled to a handle coupler 48 may become criss-crossed or otherwise connected to one another due to, for example, a lug 30 of one handle 16 becoming caught on the shaft 26 of a nearby handle 16, as suggested, for example, in FIG. 17. A handle disconnector 128 is arranged to disconnect such handles 16 that have become connected to one another to facilitate placing those handles 16 down onto belt 40 in a manner conducive to delivering handles 16 to infeed device 24 in the predetermined orientation.

In one example, handle disconnector 128 includes a pair of vertically-spaced side air pulsers 130, 132 located on opposite sides of wheel 46, as shown, for example, in FIG. 17. Each air pulser 130, 132 is arranged to direct a horizontal pulse of air at handles 16 coupled to each handle coupler 48 as handles 16 pass air pulsers 130, 132. Such pulses of air cause handles 16 to vibrate somewhat to facilitate disconnection of handles 16 that have become connected. Air pulser 130 is used to disconnect a handle 16 crossing another handle 16 in one direction and air pulser 132 is used to disconnect a handle 16 crossing another handle 16 in an opposite direction. Controller 112 is coupled to air pulsers 130, 132 to time the air pulses released therefrom at passing handles 16. Controller 112 causes air pulser 130 to discharge pulses of air through openings 134 formed in wheel 46. It is within the scope of this disclosure to include a coupler sensor (not shown) configured, for example, as a photosensor and associated with each air pulser 130, 132 to sense each handle coupler 48 that passes it and to send this information to controller 112. Controller 112 uses this information from the coupler sensors to control operation of air pursers 130, 132.

In another example, handle disconnector 128 includes a single top air pulser 131, as shown, for example, in FIG. 17. Pulser 131 is arranged to direct a downward pulse of air at handles 16 on each handle coupler 48 to disconnect criss-crossed or otherwise connected handles 16. Controller 112 is coupled to pulser 131 and a brake sensor 143 (e.g., a photosensor) to activate pulser 131 each time that brake sensor 143 senses a brake 140 which is coupled to wheel 46 and discussed in more detail herein.

Figure 18:
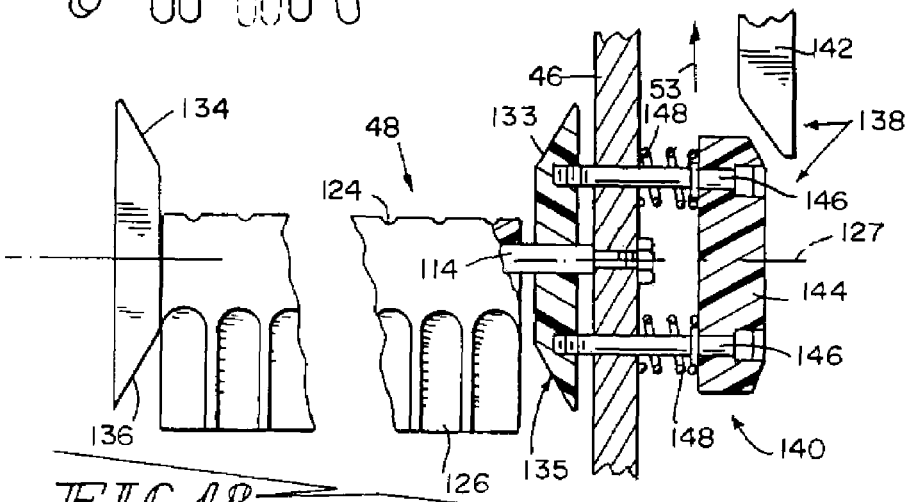
FIG. 18 is a sectional view taken along lines 18-18 of FIG. 4 showing a brake of an anti-coupler-rotation device coupled to one of the handle couplers and positioned normally in a rotation-enabling position allowing rotation of the handle coupler about a coupler axis.
Figure 19:
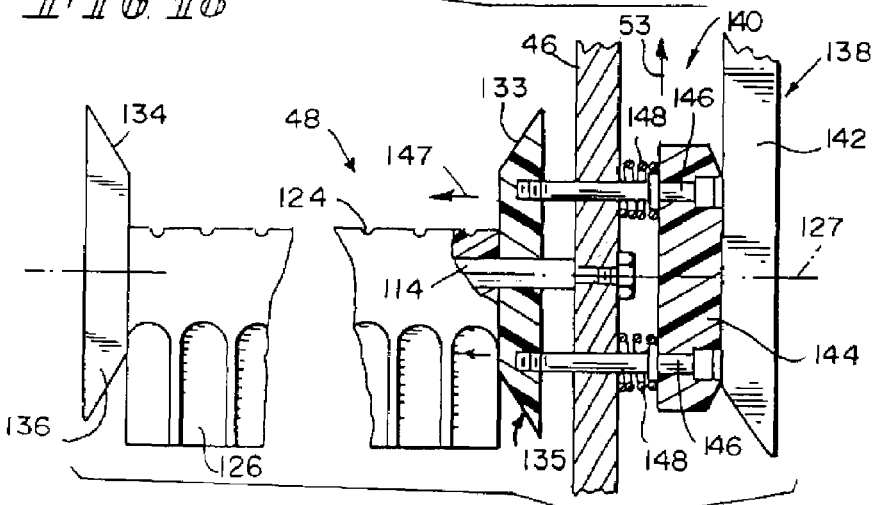
FIG. 19 is a sectional view similar to FIG. 18 showing the brake in a rotation-blocking position blocking rotation of the handle coupler about the coupler axis upon sliding engagement between the brake and a brake actuator.

Each handle coupler 48 is mounted to an axle 114 normally for rotation about a coupler axis 127 established by axle 114 upon rotation of wheel 46 about wheel rotation axis 52, as shown, for example, in FIGS. 18 and 19. Handle coupler 48 is thus normally in a generally vertical orientation to facilitate picking up handles 16 from compartments 56.

A first anti-coupler-rotation device 138 shown, for example, in FIGS. 18 and 19 is arranged to block rotation of each coupler 48 about its coupler axis 127 during rotation of handle coupler 48 with wheel 46 through an arc about wheel rotation axis 52 to lower handles 16 coupled to handle coupler 48 toward and onto moving belt 40. In this way, handle coupler 48 and any handles 16 coupled thereto will become somewhat horizontal as handle coupler 48 rotates with wheel 46 through the arc to facilitate laying handles 16 down onto moving belt 40.

Figure 20:
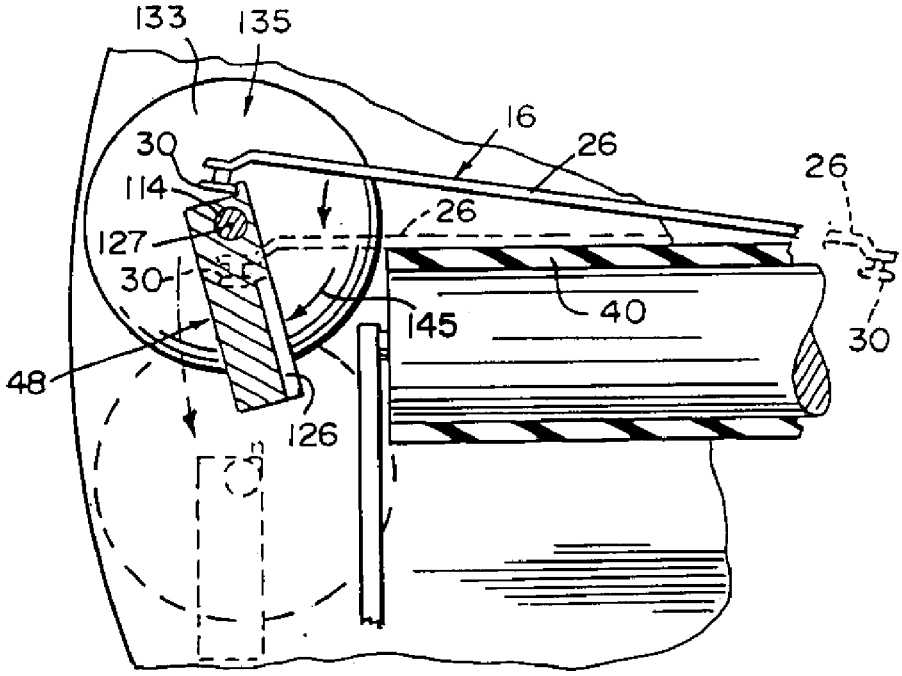
FIG. 20 is a sectional view taken along lines 20-20 of FIG. 4 showing a handle coupler laying a handle down onto a moving belt so that two lugs coupled to opposite ends of a shaft of the handle and used to couple the handle to a container extend downwardly from the shaft.

Device 138 includes a plurality of coupler brakes 140 coupled to wheel 46 and a first brake actuator 142 for actuating brakes 140, as shown, for example, in FIGS. 18 and 19 with respect to one coupler brake 138. Each brake 138 is associated with one of handle couplers 48 and arranged to move relative thereto between a normal rotation-enabling position allowing rotation of handle coupler 48 about axis 127, as shown, for example, in FIG. 18, and a rotation-blocking position blocking rotation of handle coupler 48 about axis 127, as shown, for example, in FIG. 19. Brake actuator 142 is arranged to move brake 138 from the rotation-enabling position to the rotation-blocking position when brake 138 engages brake actuator 142. Brake 138 remains in the rotation-blocking position as it travels through the arc which is established by brake actuator 142. Brake 138 disengages brake actuator 142 and returns to the rotation-enabling position at the end of the arc. Handle coupler 48 rotates in a direction 145 shown, for example, in FIG. 20 to lay handles 16 coupled thereto down onto belt 40 when brake 138 disengages brake actuator 142.

Illustratively, each brake 140 includes a pressure plate 135, a slide plate 144, and a pair of connector bolts 146 extending through wheel 46 and connecting plates 135, 144, as shown, for example, in FIGS. 18 and 19. A spring 148 surrounding each bolt 146 and located between slide plate 144 and wheel 46 biases brake 140 toward its rotation-enabling position. Brake actuator 142 is configured, for example, as a striker plate arranged to engage slide plate 144 to cause brake 140 to move from its rotation-enabling position to its rotation-blocking position in a braking direction 147. Sliding engagement between actuator 142 and slide plate 144 causes slide plate 144 to move toward wheel 46 against a biasing force generated by springs 148. This motion of slide plate 144 is transmitted through bolts 146 to pressure plate 135 which contacts an end portion 122 of coupler 48 to sandwich coupler 48 between plates 135, 136 to thereby block rotation of coupler 48 about axis 127. Springs 148 return brake 140 to the rotation-enabling position upon disengagement between slide plate 144 and actuator 142. It is within the scope of this disclosure to place a spring between coupler 48 and plate 136 to accommodate component tolerances.

Brake actuator 142 is coupled to a number (e.g., three) of actuator mount posts 150, as shown, for example, in FIGS. 4 and 6. A pair of springs 152 is positioned between brake actuator 142 and two of posts 150 to allow movement of actuator 142 during contact with slide plate 144.

A second brake actuator 154 shown, for example, in FIGS. 4 and 6 is arranged to engage brakes 140 before first brake actuator 142 engages brakes 140. Coupler 48 may tend to rock back and forth about its axis 127 when it picks up handles 16 from a compartment 56. Brake actuator 154 is positioned to actuate each brake 140 briefly to stop such rocking and associated swinging of handles 16 coupled to coupler 48. Second brake actuator 154 is configured, for example, as a striker plate that is smaller than the striker plate of first brake actuator 142.

Figure 21:
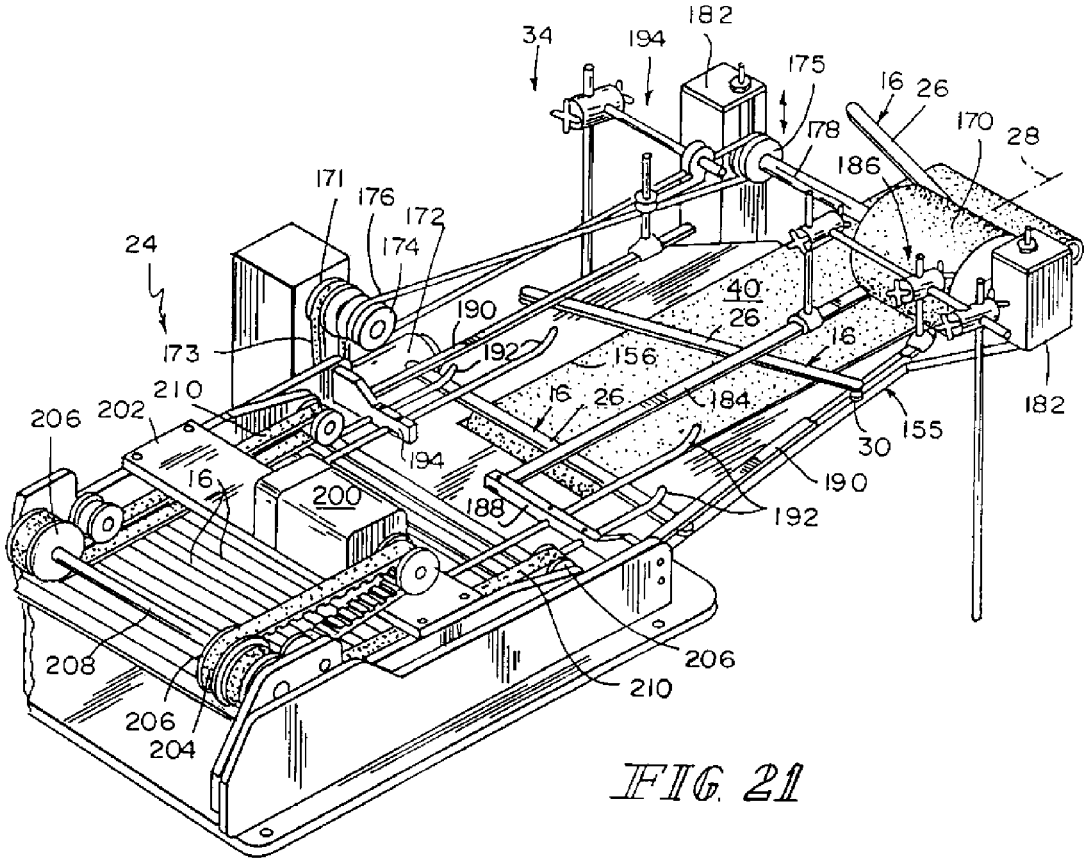
FIG. 21 is a perspective view showing a shaft orienter that is included in the handle orienter and includes the moving belt and a deck formed to include an orientation adjuster adapted to adjust the orientation of the shafts of handles placed on the belt so that the shafts become perpendicular to a shaft orientation axis along which the belt moves the handles toward the infeed device.
Figures 22, 23:
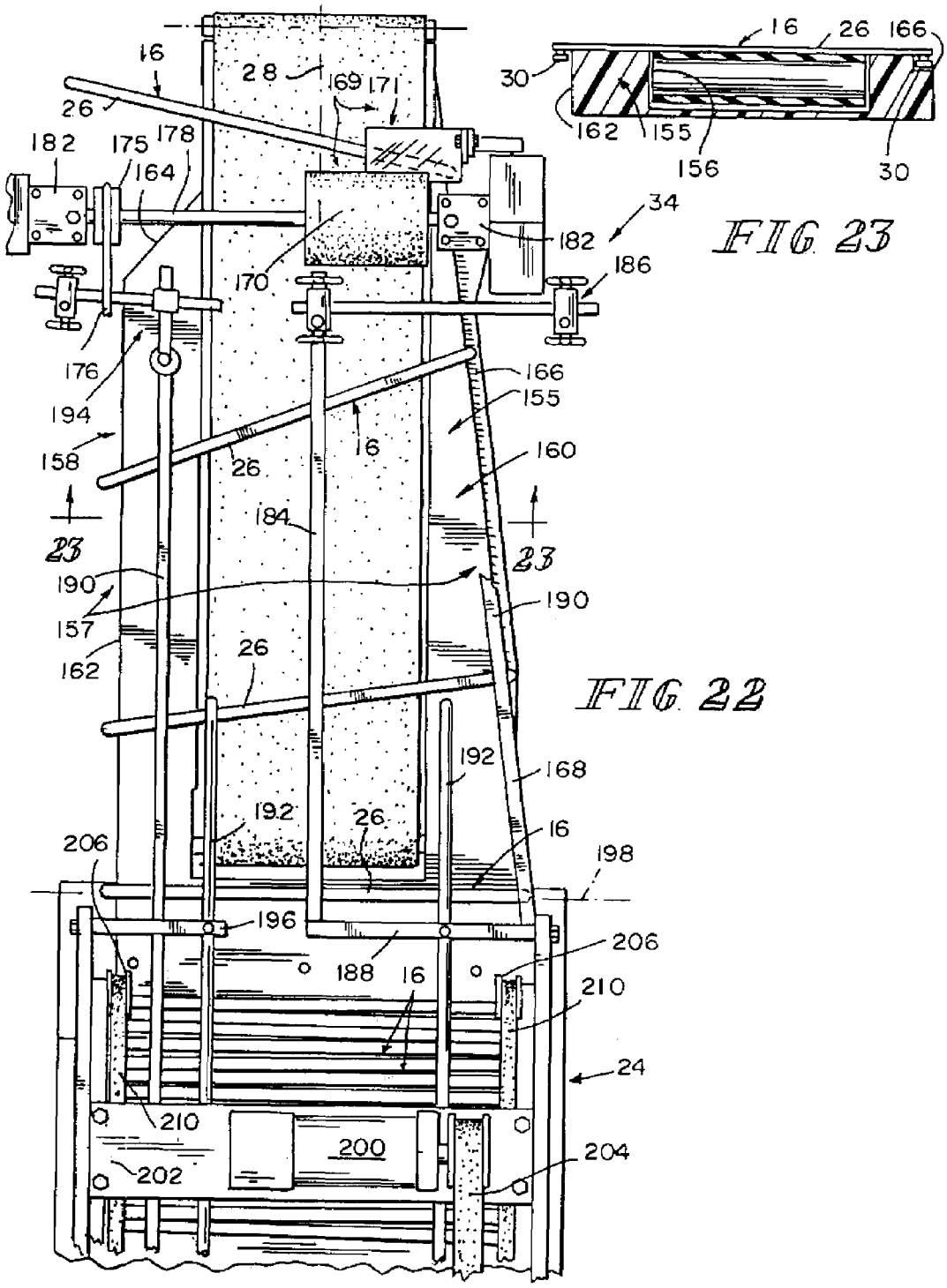
FIG. 22 is a top plan view showing adjustment of the orientation of the shafts of handles placed on the belt upon movement of the handles along the orientation adjuster by use of the moving belt so that the handles are delivered to the infeed device with the predetermined orientation in which the lugs of each handle extend downwardly from the shaft of the handle and the shaft is perpendicular to the orientation axis.
FIG. 23 is a sectional view taken along lines 23-23 of FIG. 22 showing the orientation adjuster including a side wall of the deck on one side (left side) of the belt for engaging and guiding a first lug of each handle upon movement of the handle by the belt and a notch formed in the deck on an opposite side (right side) of the belt for engaging and guiding a second lug of each handle upon movement of the handle by the belt.

Belt 40 is coupled to a deck 155 of shaft orienter 34, as shown, for example, in FIGS. 21-23. Belt 40 is positioned in an opening 156 formed in deck 155.

Handle couplers 48 release handles 16 onto moving belt 40. When released, lugs 30 extend downwardly from shafts 26. However, because belt 40 is moving, shafts 26 of handles 16 are oblique to shaft orientation axis 28 upon release from handle couplers 48.

An orientation adjuster 157 included in shaft orienter 34 is arranged to adjust the orientation of each handle 16 received on belt 40 upon movement of belt 40 toward infeed device 24 so that each shaft 26 becomes perpendicular to shaft orientation axis 28 for delivery to infeed device 24, as shown, for example, in FIGS. 21-23. Adjuster 157 includes a first lug guide 158 and a second lug guide 160. Lug guides 158, 160 are positioned on opposite sides of belt 40. First lug guide 158 is arranged to engage and guide movement of a first lug 30 of each handle 16 upon movement of handle 16 by belt 40 along axis 28. Second lug guide 160 is arranged to engage and guide movement of a second lug 30 of each handle 16 upon movement of handle 16 by belt 40 along axis 28.

First lug guide 158 includes a first side wall 162 of deck 155 and a diverging wall 164 of deck 155, as shown, for example, in FIG. 22. Wall 164 diverges outwardly toward first side wall 162 to guide a first lug 30 of each handle 16 thereto.

Second lug guide 160 includes a diverging notch 166 formed in deck 155 and a second side wall 168 parallel to first side wall 162, as shown, for example, in FIGS. 21-23. Notch 166 diverges away from first side wall 162 toward second side wall 168 to receive and guide a second lug 30 of each handle 16 toward second side wall 168.

A motion facilitator 169 is arranged to facilitate entry of second lug 30 into notch 166, as shown, for example, in FIGS. 21 and 22. Motion facilitator 169 includes an inclined plate 171 and a roller 170. Plate 171 is inclined relative to a horizontal reference plane and is positioned in front of roller 170 to push shafts 26 (which may bowed somewhat upwardly) downward toward belt 40 so that handles 16 can pass under roller 170. Roller 170 is arranged to hold each handle 16 down on belt 40 and cooperates with belt 40 to move handle 16 forward along axis 28 so that second lug 30 enters into notch 166.

A driver 172 (e.g., electric motor) is used to move roller 170 and belt 40 at the same speed. Driver 172 is arranged to rotate roller 170 through a belt 173 that connects a pair of pulleys 171 (one shown in FIG. 14), a belt 176 that connects a pair of pulleys 174, 175, and a roller axle 178 that connects pulley 175 and roller 170. A pair of mounts 182 are arranged to mount roller 170, roller axle 178, and pulley 175. Illustratively, pulleys 174, 175 are mounted so that belt 176 is positioned outwardly from a post 177. It is within the scope of this disclosure for pulleys 174, 175 to be mounted so that belt 176 is positioned inwardly from post 177. It is further within the scope of this disclosure to include a spring in each mount 182 to allow vertical movement of roller 170 in response to movement of handles 16 between roller 170 and belt 40.

An anti-slip rail 184 extends over and along belt 40, as shown, for example, in FIGS. 21 and 22. Rail 184 holds handles 16 down in contact with belt 40 to prevent handles 16 from slipping thereon so that handles 16 move with belt 40 along axis 28. Opposite ends of rail 184 are coupled to first and second rail mounts 186, 188.

Outer anti-handle-rotation rails 190 and inner anti-handle-rotation rails 192 are coupled to first and second rail mounts 186, 188 and third and fourth rail mounts 194, 196, as shown, for example, in FIGS. 21 and 22. Rails 190, 192 are arranged to block rotation of each handle 16 about its longitudinal axis 198 upon movement of handle 16 by belt 40 along axis 28. Rails 190, 192 and mounts 186, 188, 190, 192 thus cooperate to provide an anti-handle-rotation device.

Infeed device 24 is arranged to move handles 16 received from shaft orienter 34 with the predetermined orientation along axis 28 to feed handles 16 to bailer 12. Illustratively, infeed device 24 is available from Albright Machine located in Monroeville, Ohio and has model number 808-1005-A. Infeed device 24 includes a driver 200 (e.g., electric motor) coupled to a driver mount plate 202. Driver 200 rotates a drive belt 204 which acts through pulleys 206 and a pulley axle 208 to cause rotation of side belts 206 surrounding pulleys 206 to move handles 16 with the predetermined orientation along axis 28 toward bailer 12 for transfer thereto. An example of bailer 12 is available from Albright Machine also and has model number 808.

Figure 24:
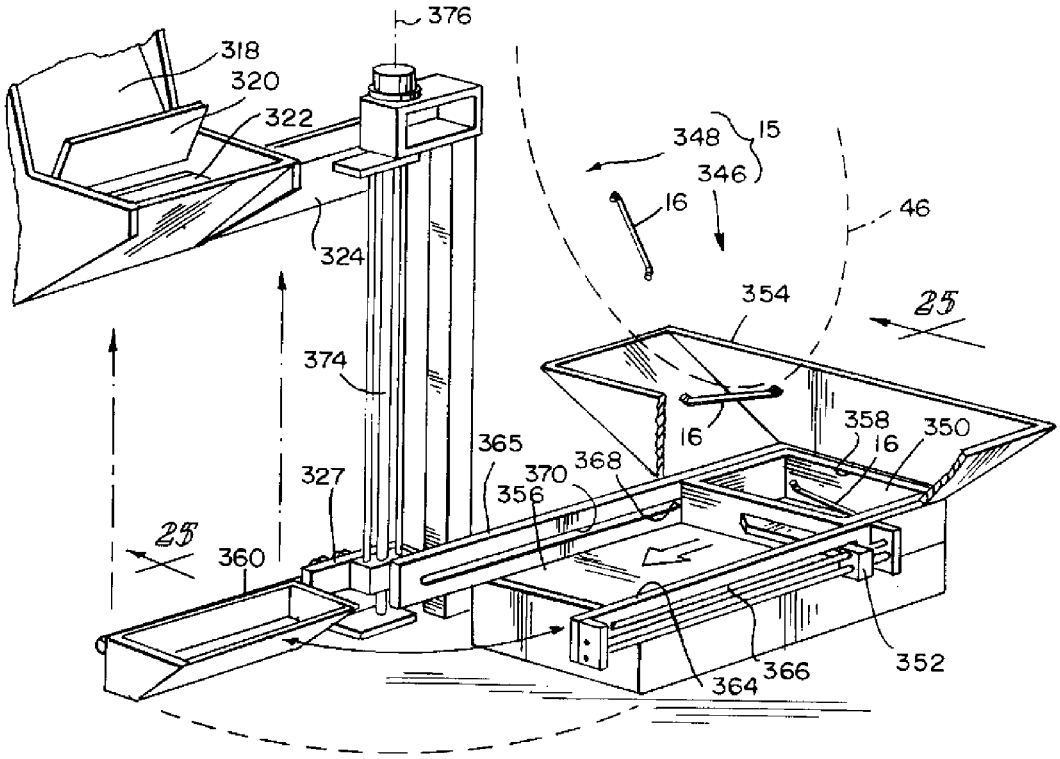
FIG. 24 is a perspective view of the handle return device.
Figure 25:
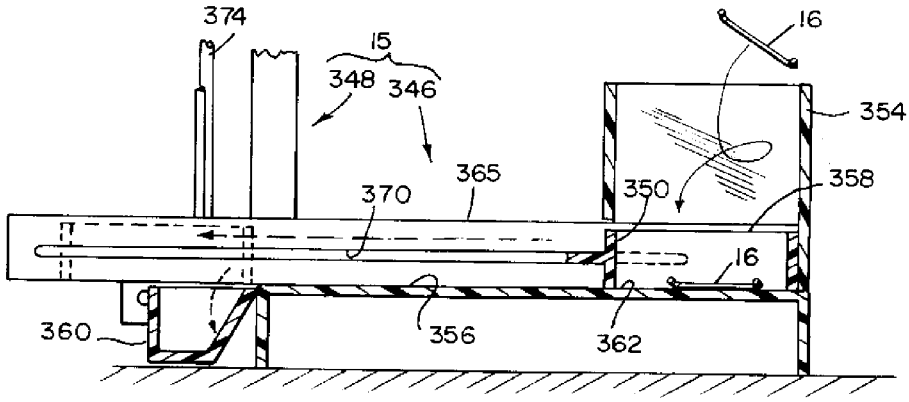
FIG. 25 is a sectional view taken along lines 25-25 showing a sleeve included in the catcher and positioned in a catch position (shown in solid lines) to receive handles that fall from the bailer feeder through a guide chute into the sleeve and onto a platform supporting the sleeve and showing a tray positioned in a lower reception position at an end of the platform to receive handles from the sleeve upon movement of the sleeve to a release position (shown in phantom lines)
Figures 26, 27:
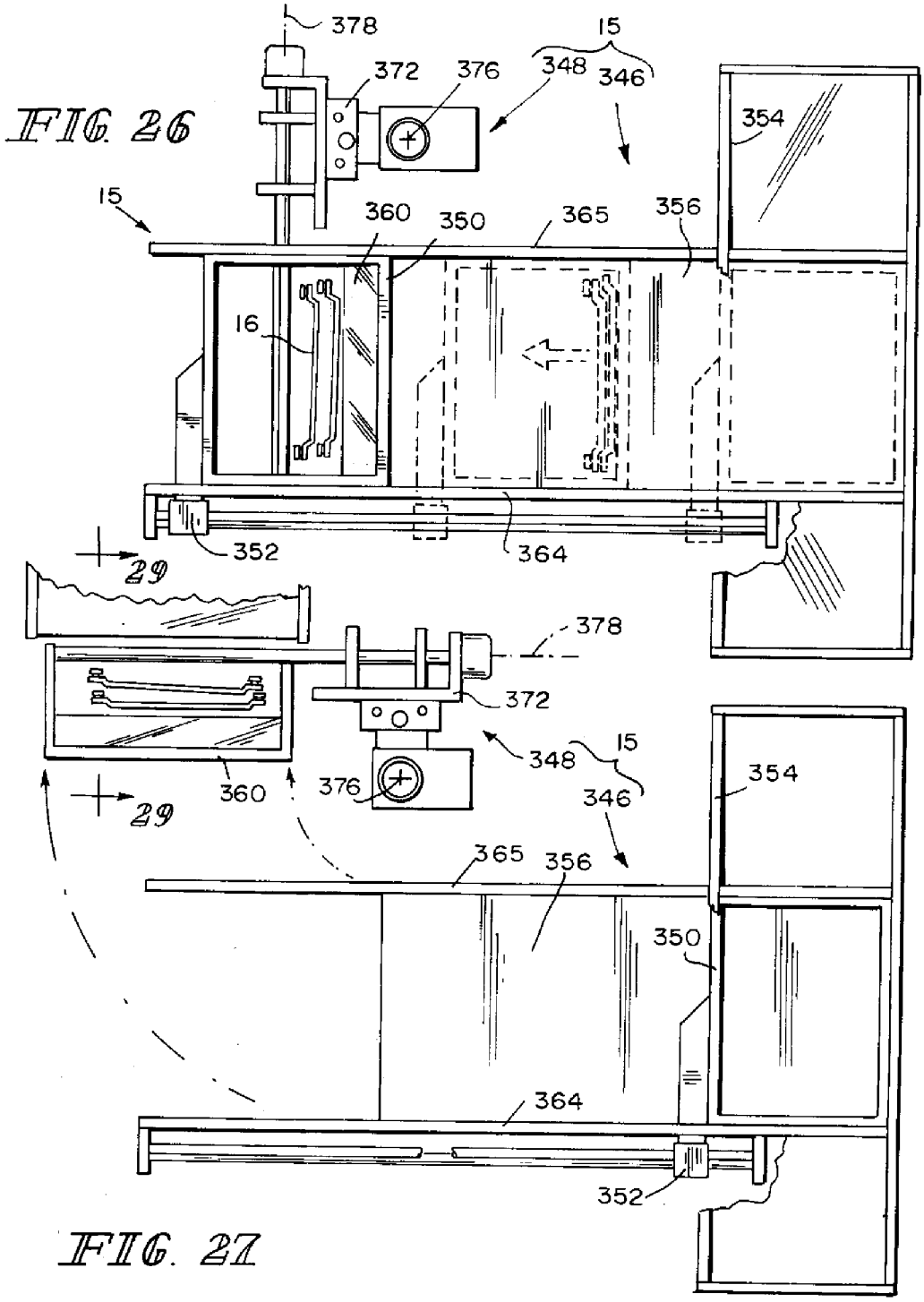
FIG. 26 is a top plan view showing movement of the sleeve along the platform from its catch position to its release position in response to movement of a sleeve shuttler.
FIG. 27 is a top plan view showing pivoting of the tray about a vertical rail axis of a vertical guide rail from the lower reception position to a lower intermediate position.
Figure 28:
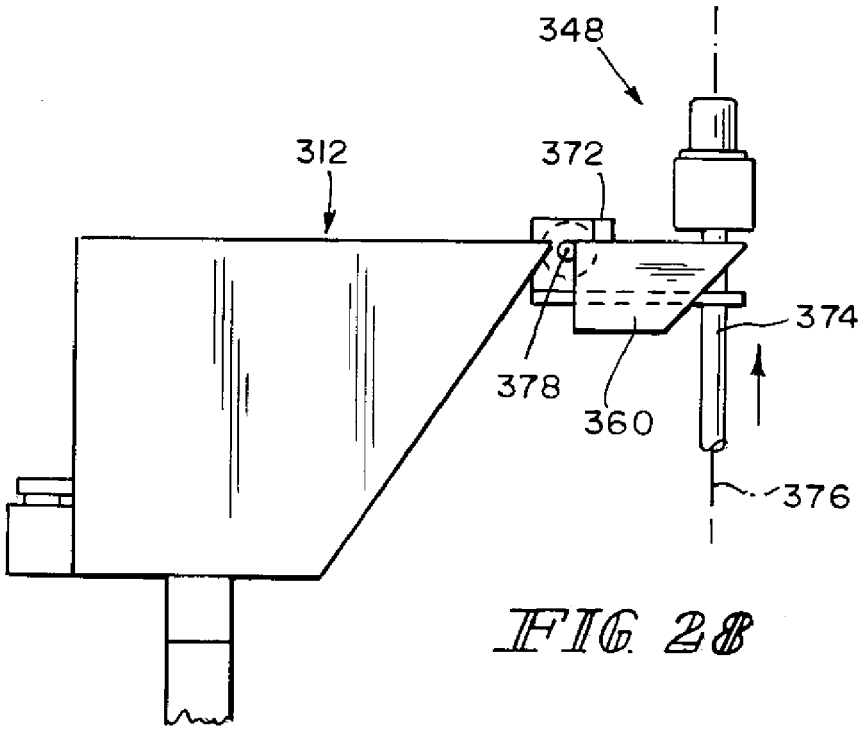
FIG. 28 is an elevational view showing upward movement of the tray along the guide rail from the lower intermediate position to an upper intermediate position.
Figure 29:
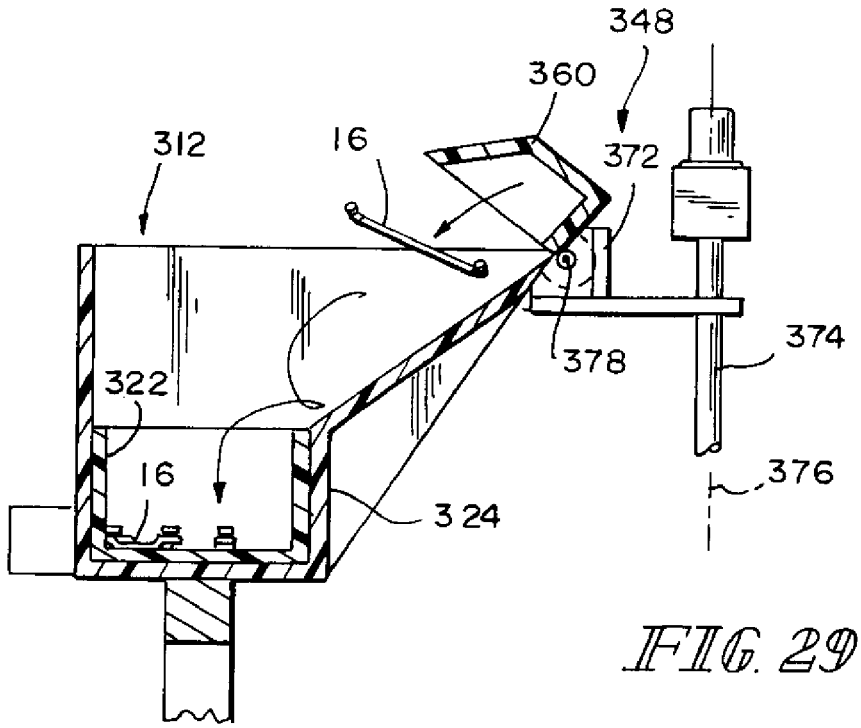
FIG. 29 is a sectional view taken along lines 29-29 of FIG. 27 showing rotation of the tray about a horizontal tray axis from the upper intermediate position to the upper release position for return of handles located in the tray to the collection box included in the handle supplier of the bailer feeder.

Handle return device 15 shown, for example, in FIG. 24 is arranged to return handles 16 that fall from bin 42 and handle couplers 48 back to collection box 322. Return device 15 includes a catcher 346 and an elevator 348. Catcher 346 is arranged to catch handles 16 that fall from bin 42 and handle couplers 48. Catcher 346 thus provides catcher means for catching handles 16 that fall from bailer feeder 14. Elevator 348 is arranged to elevate handles 16 caught by catcher 346 and to return such handles 16 to collection box 322. Elevator 348 thus provides elevator means for elevating handles 16 caught by the catcher means.

Catcher 346 includes a sleeve 350, a sleeve shuttler 352, a guide chute 354, and a platform 356, as shown, for example, in FIGS. 24-27. Sleeve shuttler 352 is coupled to sleeve 350 and configured, for example, as an air cylinder to move sleeve 350 along platform 356 between a catch position shown in solid in FIGS. 24, 25, and 27 and in phantom in FIG. 26 and a release position shown in solid in FIG. 26 and in phantom in FIG. 25. In the catch position, sleeve 350 underlies guide chute 354 to allow guide chute 354 to guide handles 16 that fall from bin 42 and handle couplers 48 through a top opening 358 formed in sleeve 350 into sleeve 350 and onto platform 356. In the release position, sleeve 350 is located over a tray 360 that is included in elevator 348 and located in a lower reception position next to an end of platform 356 to allow handles 16 to fall through a bottom opening 362 formed in sleeve 350 into tray 360.

Catcher 346 includes parallel first and second guide rails 364, 365, as shown, for example, in FIG. 24. Rails 364 extend along opposite sides of platform 356. Sleeve shuttler 352 extends through a slot 366 formed in first side rail 364 to sleeve 350. A follower 368 of sleeve 350 extends through a slot 370 formed in second guide rail 364.

Elevator 348 includes tray 360, a tray mover 372, and a vertical tray guide rail 374 having a vertical rail axis 376, as shown, for example, in FIGS. 24-29. To deposit handles 16 located in tray 360 into collection box 322, tray mover 372 first pivots tray 360 about axis 376 from the lower reception position for receiving handles 16 from sleeve 350, as shown, for example, in FIGS. 25 and 26 to a lower intermediate position shown, for example, in FIGS. 24 and 26. Tray mover 372 then raises tray 360 along tray guide rail 374 and axis 376 from the lower intermediate position to an upper intermediate position which is higher than the lower intermediate position, as shown, for example, in FIG. 28. Tray mover 372 rotates tray 360 about a horizontal tray axis 378 from the upper intermediate position to an upper release position in which tray 360 is tipped to discharge handles 16 located in tray 360 into collection box 322, as shown, for example, in FIG. 29. Tray mover 372 then returns tray 360 to the lower reception position to receive a new load of handles 16 from catcher 346.

Figure 30:
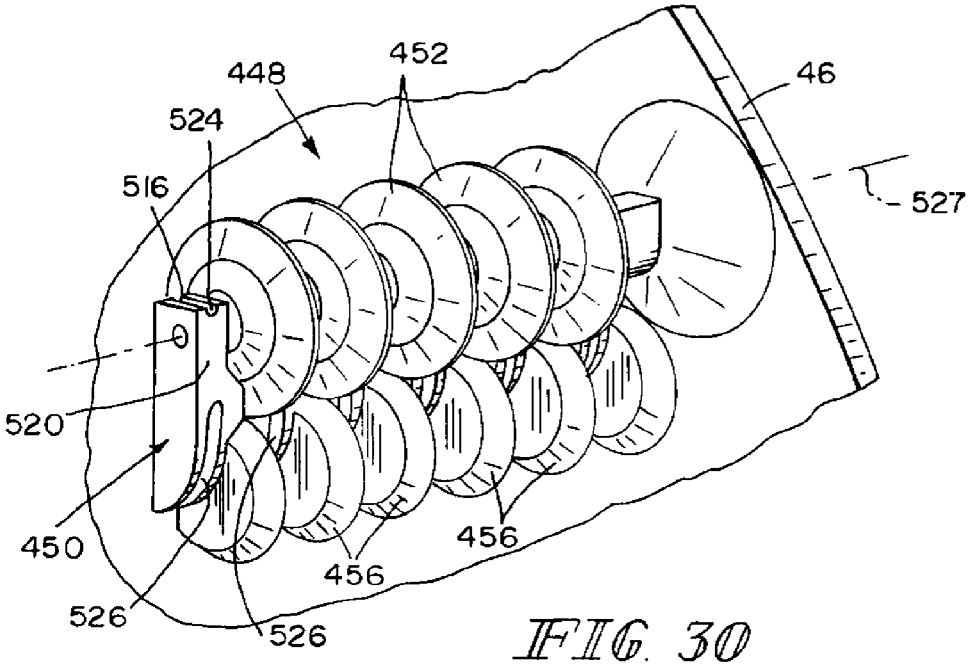
FIG. 30 is a perspective view of another handle coupler for use in the bailer feeder.
Figure 31:
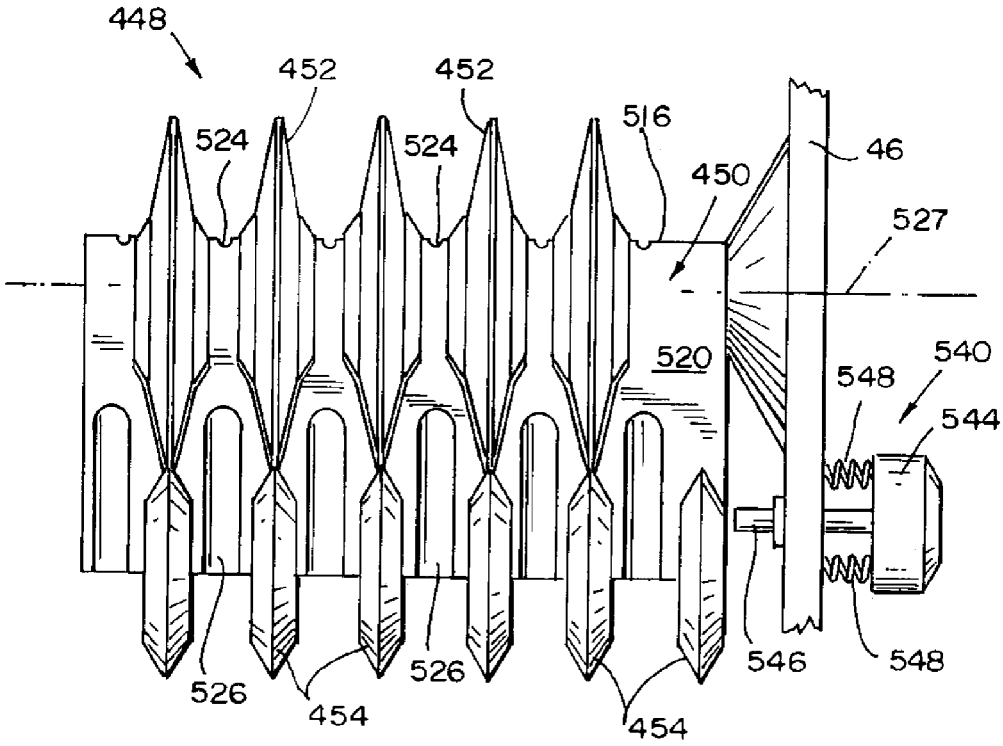
FIG. 31 is a front elevational view of the handle coupler of FIG. 30.

It is within the scope of this disclosure for bailer feeder 14 to include a handle coupler 448 in place of each handle coupler 48, as shown, for example, in FIGS. 30 and 31. Each coupler 448 includes a plate 450 having a top portion 516 formed to include a plurality of spaced-apart lug receivers 524 configured, for example, as notches to receive lugs 30 and a side portion 520 formed to include a plurality of spaced-apart shaft receivers 526 configured, for example, as slots to receive shafts 26. A coupler axle (not shown) extends through plate 450 for rotation of plate 450 about an axis 527 defined by the coupler axle.

Coupler 448 includes a plurality of handle separators 452 shown, for example, in FIGS. 30 and 31 and arranged to separate handles 16 that are coupled to plate 450 to minimize crisscrossing of adjacent handles 16. Each separator 452, except for the separator closest to wheel 46, includes an upper guide disk 452 and a lower guide disk 454.

An upper guide disk 452 is coupled to the coupler axle between adjacent pairs of lug receivers 524 to guide handles 16 toward lug receivers 524 located to opposite sides of disk 452. The upper guide disks 452, except for the disk 452 located farthest from wheel 46, is mounted for rotation on the coupler axle. The disk 452 located farthest from wheel 46 is fastened to the coupler axle by use of, for example, a set screw to retain plate 450 on the coupler axle.

A lower guide disk 454 is coupled to plate 450 between adjacent pairs of shaft receivers 526 to guide handles 16 toward shaft receivers 526 located to opposite sides of disk 454. The separator 452 located closest to wheel 46 has a lower guide disk 454 but no upper guide disk 452 to allow inclined surface 456 to guide handles 16 to the lug receiver 524 located closest to surface 456. It is within the scope of this disclosure for the separator 452 located closest to wheel 46 to include an upper guide disk 452 also.

It is within the scope of this disclosure for bailer feeder 14 to include a brake 540 in place of each brake 140, as shown, for example, in FIG. 31. Brake 540 include a follower plate 544, a bolt 546, and springs 548. Bolt 546 is coupled to follower plate 544 and extends through wheel 46 normally to disengage coupler 448 due to springs 548 which move follower plate 544 away from wheel 46 and thus move bolt 546 away from coupler 448. When follower plate 544 is moved toward wheel 46 in response to engagement with brake actuator 142, bolt 546 moves in behind coupler plate 450 for engagement therewith to block rotation of coupler 448 about coupler axis 527 during rotation of wheel 46 about wheel axis 52. When follower plate 544 disengages brake actuator 142, springs 548 move follower plate 544 away from wheel 46 and thus move bolt 546 out of engagement with coupler plate 450 to allow rotation of coupler 448 about coupler axis 527 during rotation of wheel 46 about wheel axis 52.

The invention claimed is:

1. A bailing apparatus comprising a bailer adapted to couple handles to containers, a bailer feeder arranged to feed handles to the bailer, and handle return means for returning handles that have fallen from the bailer feeder from a location to which the handles have fallen back to the bailer feeder.

2. The bailing apparatus of claim 1, wherein the handle return means includes catcher means for catching handles that fall from the bailer feeder and elevator means for elevating handles caught by the catcher means.

3. The bailing apparatus of claim 2, wherein the catcher means includes a guide chute, a sleeve, a sleeve shuttler, and a platform, the elevator means includes a tray and a tray mover, the guide chute is arranged to guide handles that fall from the bailer feeder into the sleeve, the sleeve shuttler is arranged to move the sleeve and the handles located therein along the platform to a location over the tray to allow the handles located in the sleeve to fall from the sleeve into the tray, and the tray mover is arranged to move the tray between a lower reception position in which the tray is positioned to receive handles from the sleeve and an upper release position in which the tray is positioned to release handles from the tray to the bailer feeder.

4. The bailing apparatus of claim 3, wherein the elevator means includes a vertical tray guide rail having a vertical rail axis and the tray mover is arranged to pivot the tray about the rail axis away from the platform from the lower reception position to a lower intermediate position, to move the tray vertically along the tray guide rail and its rail axis from the lower intermediate position to an upper intermediate position higher than the lower intermediate position, and to rotate the tray about a horizontal tray axis from the upper intermediate position to the upper release position.

5. The bailing apparatus of claim 2, wherein the catcher means includes a sleeve and a sleeve shuttler, the elevator means includes a tray and a tray mover, the sleeve is arranged to receive handles that fall from the bailer feeder, the sleeve shuttler is arranged to move the sleeve to a location over the tray to allow handles to fall from the sleeve into the tray, and the tray mover is arranged to lift and tip the tray to release handles located in the tray to the bailer feeder.

6. The bailing apparatus of claim 1, wherein the bailer feeder includes a handle supplier adapted to supply handles without a predetermined orientation, an infeed device arranged to feed handles with the predetermined orientation to the bailer, and a handle orienter arranged to orient handles received from the handle supplier so that the handles have the predetermined orientation and arranged to deliver the oriented handles to the infeed device and the handle return means includes a catcher arranged to catch handles that fall from the handle orienter and an elevator arranged to elevate the handles caught by the catcher and to return such handles to the handle supplier.

7. The bailing apparatus of claim 6, wherein the handle orienter includes a lug orienter and a shaft orienter, the lug orienter is arranged to orient two container attachment lugs included in each handle and coupled to opposite ends of a shaft included in each handle so that the lugs extend downwardly from the shaft upon delivery of the handle to the shaft orienter by the lug orienter, the shaft orienter is arranged to orient the shaft of each handle so that the shaft is perpendicular to a shaft orientation axis along which the shaft orienter moves each handle toward the infeed device, and the catcher underlies the lug orienter to catch handles that fall from the lug orienter.

8. The bailing apparatus of claim 7, wherein the lug orienter includes a sequencer and a picker, the sequencer is arranged to move groups of handles received from the handle supplier in sequence into communication with the picker, the picker is arranged to pick up handles from whichever group is in communication with the picker and to lay down the picked-up handles onto the shaft orienter, and the catcher is positioned to catch handles that fall from the sequencer and the picker.

9. The bailing apparatus of claim 7, wherein the lug orienter includes a bin arranged to receive handles from the handle supplier, a rotatable wheel, and a plurality of handle couplers coupled to the wheel for rotation therewith to pick up handles from one of a plurality of compartments included in the bin and the catcher is positioned to catch handles that fall from the bin and the handle couplers.

10. The bailing apparatus of claim 6, wherein the handle supplier includes a conveyor belt device, a collector, and a discharger, each of the conveyor belt device and the handle return means is arranged to provide handles to the collector, and the discharger is arranged to discharge handles located in the collector to the handle orienter.

11. A bailing apparatus comprising a bailer adapted to couple handles to containers, a bailer feeder adapted to feed handles to the bailer, and a handle return device arranged to return handles that have fallen from the bailer feeder from a location to which the handles have fallen back to the bailer feeder.

12. The bailing apparatus of claim 11, wherein the handle return device includes a catcher arranged to catch handles that fall from the bailer feeder.

13. The bailing apparatus of claim 12, wherein the handle return device includes an elevator arranged to elevate handles received from the catcher and to release such handles to the bailer feeder.

14. The bailing apparatus of claim 11, wherein the handle return device includes an elevator arranged to elevate handles that have fallen from the bailer feeder and to release such handles back to the bailer feeder.

15. The bailing apparatus of claim 11, wherein the handle return device includes a guide, a sleeve, a platform, a sleeve shuttler, and a tray, the guide is arranged to guide handles that fall from the bailer feeder through a top opening formed in the sleeve into the sleeve and onto the platform, and the sleeve shuttler is arranged to slide the sleeve and handles located therein along the platform to a location over the tray to allow the handles located in the sleeve to fall into the tray through a bottom opening formed in the sleeve.

16. The bailing apparatus of claim 15, wherein the handle return device includes a tray mover and a vertical tray guide rail having a vertical rail axis and the tray mover is arranged to pivot the tray about the rail axis between a lower reception position for receiving handles from the sleeve and a lower intermediate position, is arranged to move the tray vertically along the tray guide rail between the lower intermediate position and an upper intermediate position higher than the lower intermediate position, and arranged to rotate the tray about a horizontal tray axis between the upper intermediate position and an upper release position for releasing handles located in the tray to the bailer feeder.

17. The bailing apparatus of claim 11, wherein the handle return device includes a tray, a tray mover, and a vertical guide rail having a vertical rail axis and the tray mover is arranged to pivot the tray about the rail axis between a lower reception position for receiving fallen handles and a lower intermediate position, arranged to move the tray vertically along the tray guide rail and its rail axis between the lower intermediate position and an upper intermediate position higher than the lower intermediate position, and arranged to rotate the tray about a horizontal tray axis between the upper intermediate position and an upper release position for releasing handles located in the tray to the bailer feeder.

18. The bailing apparatus of claim 11, wherein the bailer feeder includes a handle supplier, a rotatable bin including a plurality of compartments arranged to receive handles from the handle supplier, a rotatable wheel, and a plurality of handle couplers coupled to the wheel for rotation therewith to pick up handles located in the compartments and the handle return device is arranged to catch handles that fall from the compartments and the handle couplers and to return the fallen handles to the handle supplier.

19. The bailing apparatus of claim 18, wherein the handle supplier includes a conveyor belt device, a collector, and a discharger, each of the conveyor belt device and the handle return device is arranged to provide handles to the collector, and the discharger is arranged to discharge handles located in the collector into the compartments.

20. The bailing apparatus of claim 19, wherein the collector includes a box support and a collection box that is arranged to receive handles from a conveyor belt included in the conveyor belt device and a tray included in the handle return device and that is nested in the box support for movement relative thereto and the discharger includes a pusher positioned in the collection box, a pusher shuttler, and a releasable connector arranged to connect the pusher and the collection box to move the collection box relative to the box support toward the bin until the collection box engages a stop included in the box support upon movement of the pusher toward the bin by the pusher shuttler and arranged to disconnect the pusher and the collection box in response to engagement between the collection box and the stop to allow the pusher shuttler to move the pusher relative to the collection box toward the bin to push handles out of the collection box into the bin.

21. The bailing apparatus of claim 11, wherein the bailer feeder includes a conveyor belt device and a collector and each of the conveyor belt device and the handle return device is arranged to provide handles to the collector.

22. The bailing apparatus of claim 21, further comprising a controller coupled to the conveyor belt device and the handle return device and arranged to coordinate operation of the conveyor belt device and the handle return device to control when each of conveyor belt device and the handle return device is to provide handles to the collector.

23. A bailing apparatus comprising a bailer adapted to couple handles to containers, a bailer feeder arranged to feed handles to the bailer, the bailer feeder including a handle supplier, a bin arranged to receive handles from the handle supplier, a rotatable wheel, and a plurality of handle couplers coupled to the wheel for rotation therewith to pick up handles from the bin, and a handle return device including a catcher and an elevator, the catcher being arranged to catch handles that fall from the bin and the handle couplers and to deliver the caught handles to the elevator, the elevator being arranged to elevate the handles received from the catcher and to return the handles received from the catcher to the handle supplier.

24. The bailing apparatus of claim 23, wherein the elevator includes a tray and the catcher includes a platform and a sleeve arranged to receive handles from the bin and the handle couplers through a top opening formed in the sleeve and to slide along the platform to slide handles located in the sleeve along the platform to a location over the tray to allow the handles located in the sleeve to fall into the tray through a bottom opening formed in the sleeve.

25. The bailing apparatus of claim 24, wherein the catcher includes a guide chute arranged to guide handles that fall from the bin and the handle couplers into the sleeve through the top opening formed in the sleeve.

26. The bailing apparatus of claim 24, wherein the catcher includes a sleeve shuttler arranged to slide the sleeve along the platform between a catch position for catching handles that fall from the bin and the handle couplers and a release position for releasing handles into the tray.

27. The bailing apparatus of claim 23, wherein the elevator includes a tray and a tray mover arranged to move the tray between a lower reception position for receiving handles from the catcher and an upper release position for releasing handles located in the tray to the handle supplier.

28. The bailing apparatus of claim 27, wherein the elevator includes a vertical tray guide rail having a vertical rail axis and the tray mover is arranged to pivot the tray about the rail axis between the lower reception position and a lower intermediate position, arranged to move the tray vertically along the tray guide rail and its rail axis between the lower intermediate position and an upper intermediate position higher than the lower intermediate position, and arranged to rotate the tray about a horizontal tray axis between the upper intermediate position and the upper release position.

29. The bailing apparatus of claim 23, wherein the handle supplier includes a collection box arranged to receive handles from the elevator, a pusher positioned in the collection box, and a pusher shuttler arranged to move the pusher relative to the collection box to push handles out of the collection box into the bin.

30. The bailing apparatus of claim 29, wherein the handle supplier includes a box support supporting the collection box and a releasable connector, the releasable connector is arranged to connect the pusher and the collection box to move the collection box relative to the box support toward the bin until the collection box engages a stop included in the box support upon movement of the pusher toward the bin by the pusher shuttler, and the releasable connector is arranged to disconnect the pusher and the collection box in response to engagement between the collection box and the stop to allow the pusher shuttler to move the pusher relative to the collection box toward the bin and to push handles out of the collection box into the bin.

31. The bailing apparatus of claim 30, wherein the releasable connector includes a first magnet coupled to the pusher and a second magnet coupled to the collection box.

32. The bailing apparatus of claim 30, wherein the box support is formed to include a longer support slot and a shorter support slot that is shorter than the longer support slot, the collection box is formed to include a box slot, the stop is located at an end of the box slot, the pusher shuttler extends through the longer support slot and the box slot to the pusher for movement of the pusher shuttler in the longer support slot and the box slot to move the pusher toward and away from the bin, and the collection box includes a follower extending into the box slot for movement of the follower along the box slot into and out of engagement with the stop.

* * * * *